US008487521B2

(12) United States Patent
Hirakawa et al.

(10) Patent No.: US 8,487,521 B2
(45) Date of Patent: Jul. 16, 2013

(54) ELECTRON EMITTING ELEMENT, METHOD FOR PRODUCING ELECTRON EMITTING ELEMENT, ELECTRON EMITTING DEVICE, CHARGING DEVICE, IMAGE FORMING APPARATUS, ELECTRON-BEAM CURING DEVICE, LIGHT EMITTING DEVICE, IMAGE DISPLAY DEVICE, AIR BLOWING DEVICE, AND COOLING DEVICE

(75) Inventors: Hiroyuki Hirakawa, Osaka (JP); Yasuo Imura, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 369 days.

(21) Appl. No.: 12/956,136

(22) Filed: Nov. 30, 2010

(65) Prior Publication Data

US 2011/0129256 A1 Jun. 2, 2011

(30) Foreign Application Priority Data

Dec. 1, 2009 (JP) ..... 2009-273724

(51) Int. Cl.
*H01J 1/00* (2006.01)

(52) U.S. Cl.
USPC ..... 313/311; 399/168

(58) Field of Classification Search
USPC ..... 313/311; 399/168
See application file for complete search history.

(56) References Cited

U.S. PATENT DOCUMENTS 3,644,161 A 2/1972 Hall
4,857,161 A 8/1989 Borel
5,891,548 A 4/1999 Graiver
5,962,959 A 10/1999 Iwasaki et al.
6,023,124 A 2/2000 Chuman et al.
6,130,503 A 10/2000 Negishi et al.
6,166,487 A 12/2000 Negishi et al.
6,462,467 B1 10/2002 Russ
6,626,724 B2 9/2003 Yamamoto et al.
6,628,053 B1 9/2003 Den et al.
6,803,707 B2 10/2004 Ishiwata et al.
6,844,664 B2 1/2005 Komoda et al.
7,723,909 B2 5/2010 Yamaguchi et al.
8,110,971 B2 2/2012 Hirakawa et al.
2001/0017369 A1 8/2001 Iwasaki et al.
2001/0026123 A1 10/2001 Yoneda
2002/0070677 A1 6/2002 Yamada et al.

(Continued)

FOREIGN PATENT DOCUMENTS

CN 1755889 A 4/2006
CN 1763885 A 4/2006

(Continued)

OTHER PUBLICATIONS

Notice of Allowance mailed Nov. 29, 2011 in U.S. Appl. No. 12/782,102.

(Continued)

*Primary Examiner* — Mary Ellen Bowman
(74) *Attorney, Agent, or Firm* — Nixon & Vanderhye, P.C.

(57) ABSTRACT

An electron emitting element of the present invention includes: an electrode substrate; a thin-film electrode; and an electron acceleration layer sandwiched between the electrode substrate and the thin-film electrode, the electron acceleration layer including (i) conductive fine particles, (ii) insulating fine particles having an average particle diameter greater than an average particle diameter of the conductive fine particles, and (iii) a crystalline electron transport agent. The crystalline electron transport agent is crystallized in the acceleration layer.

23 Claims, 14 Drawing Sheets

U.S. PATENT DOCUMENTS

| | | | |
|---|---|---|---|
| 2002/0136896 | A1 | 9/2002 | Takikawa et al. |
| 2003/0076023 | A1 | 4/2003 | Komoda et al. |
| 2003/0102793 | A1 | 6/2003 | Komoda et al. |
| 2004/0021434 | A1 | 2/2004 | Yoneda |
| 2004/0046914 | A1 | 3/2004 | Hirota |
| 2004/0150768 | A1 | 8/2004 | Shimizu et al. |
| 2004/0197943 | A1 | 10/2004 | Izumi |
| 2004/0201345 | A1 | 10/2004 | Hirokado |
| 2004/0246408 | A1 | 12/2004 | Ando |
| 2005/0181566 | A1 | 8/2005 | Machida et al. |
| 2005/0212398 | A1 | 9/2005 | Okano et al. |
| 2006/0012278 | A1 | 1/2006 | Nanataki et al. |
| 2006/0061967 | A1 | 3/2006 | Kim et al. |
| 2006/0065895 | A1 | 3/2006 | Kusunoki et al. |
| 2006/0152138 | A1 | 7/2006 | Hori et al. |
| 2006/0186786 | A1 | 8/2006 | Iwamatsu et al. |
| 2006/0244357 | A1 | 11/2006 | Lee |
| 2006/0284543 | A1 | 12/2006 | Chung et al. |
| 2006/0290291 | A1 | 12/2006 | Aizawa |
| 2006/0291905 | A1 | 12/2006 | Hirakawa et al. |
| 2007/0210697 | A1 | 9/2007 | Tamura et al. |
| 2007/0222067 | A1 | 9/2007 | Nanataki et al. |
| 2009/0091526 | A1 | 4/2009 | Hirota |
| 2010/0196050 | A1 | 8/2010 | Iwamatsu et al. |
| 2010/0215402 | A1 | 8/2010 | Nagaoka et al. |
| 2010/0278561 | A1 | 11/2010 | Kanda et al. |
| 2010/0295465 | A1 | 11/2010 | Hirakawa et al. |
| 2010/0296842 | A1 | 11/2010 | Imura et al. |
| 2010/0296843 | A1 | 11/2010 | Hirawaka et al. |
| 2010/0296844 | A1 | 11/2010 | Imura et al. |
| 2010/0296845 | A1 | 11/2010 | Hirakawa et al. |
| 2010/0307724 | A1 | 12/2010 | Ichii et al. |
| 2010/0327730 | A1 | 12/2010 | Hirakawa et al. |

FOREIGN PATENT DOCUMENTS

| | | | |
|---|---|---|---|
| CN | 1849673 | A | 10/2006 |
| EP | 1 617 449 | | 1/2006 |
| EP | 1 617 450 | A2 | 1/2006 |
| EP | 1 635 369 | | 3/2006 |
| JP | 60-20027 | A | 2/1985 |
| JP | 62-172631 | | 7/1987 |
| JP | 1-107440 | A | 4/1989 |
| JP | 1-149335 | A | 6/1989 |
| JP | 1-279557 | | 11/1989 |
| JP | 1-298623 | | 12/1989 |
| JP | 1-298623 | A | 12/1989 |
| JP | 6-255168 | A | 9/1994 |
| JP | 8-97582 | A | 4/1996 |
| JP | 8-250766 | A | 9/1996 |
| JP | 9-007499 | A | 1/1997 |
| JP | 9-252068 | A | 9/1997 |
| JP | 10-121042 | | 5/1998 |
| JP | 10-308164 | A | 11/1998 |
| JP | 10-308165 | | 11/1998 |
| JP | 10-308166 | A | 11/1998 |
| JP | 11-251069 | A | 9/1999 |
| JP | 2000-76986 | A | 3/2000 |
| JP | 2000-311640 | | 11/2000 |
| JP | 2001-68012 | A | 3/2001 |
| JP | 2001-195973 | A | 7/2001 |
| JP | 2001-357961 | | 12/2001 |
| JP | 2002-93310 | A | 3/2002 |
| JP | 2002-208346 | A | 7/2002 |
| JP | 2002-279892 | A | 9/2002 |
| JP | 2003-115385 | | 4/2003 |
| JP | 2003-173744 | A | 6/2003 |
| JP | 2003-173878 | A | 6/2003 |
| JP | 2003-331712 | | 11/2003 |
| JP | 2004-241161 | | 8/2004 |
| JP | 2004-253201 | A | 9/2004 |
| JP | 2004-296781 | | 10/2004 |
| JP | 2004-296950 | | 10/2004 |
| JP | 2004-327084 | A | 11/2004 |
| JP | 2005-5205 | A | 1/2005 |
| JP | 2005-190878 | A | 7/2005 |
| JP | 2005-209396 | A | 8/2005 |
| JP | 2005-268025 | A | 9/2005 |
| JP | 2005-326080 | A | 11/2005 |
| JP | 2005-328041 | A | 11/2005 |
| JP | 2006-054162 | | 2/2006 |
| JP | 2006-100758 | A | 4/2006 |
| JP | 2006-190545 | A | 7/2006 |
| JP | 2006-236964 | | 9/2006 |
| JP | 2006-351524 | A | 12/2006 |
| JP | 2007-290873 | | 11/2007 |
| JP | 2009-019084 | A | 1/2009 |
| JP | 2009-092902 | A | 4/2009 |
| JP | 2009-46891 | A | 7/2009 |
| JP | 4314307 | B1 | 8/2009 |
| JP | 2010-267492 | A | 11/2010 |
| TW | 1237722 | | 8/2005 |
| TW | I237722 | | 8/2005 |
| TW | 1257117 | | 6/2006 |
| TW | I257117 | | 6/2006 |
| TW | 200638455 | A | 11/2006 |
| TW | 1278696 | | 4/2007 |
| TW | I278696 | | 4/2007 |
| WO | 98/27568 | A1 | 6/1998 |
| WO | 2005/004545 | A1 | 1/2005 |
| WO | WO 2009/066723 | | 5/2009 |

OTHER PUBLICATIONS

Notice of Allowance mailed Dec. 29, 2011 in U.S. Appl. No. 12/782,102.

Office Action mailed Nov. 29, 2011 in U.S. Appl. No. 12/698,435.

Office Action mailed Dec. 16, 2011 in U.S. Appl. No. 12/698,435.

U.S. Appl. No. 12/940,546, filed Nov. 5, 2010, entitled "Heat Exchanger".

English version of ISR for PCT/JP2009/052904 mailed Apr. 21, 2009.

ISR for PCT/JP2008/071102, mailed Feb. 24, 2009.

Electrophotography-Bases and Applications (1998; p. 213), The Society of Electrophotography of Japan, Corona Publishing Co., Ltd. (with partial English translation).

Ionic winds for locally enhanced cooling, David B. Go, Suresh V. Garimella, and Timothy S. Fisher, J. Appl. Phys., 102, 053302 (2007).

Naoi et al, "TiO2 Films Loaded with Silver Nanoparticles: Control of Multicolor Photochromic Behavior" J. Am. Chem. Soc., vol. 126, No. 11, p. 3664-3668 (2004).

Yamaguchi and three others, "Development of Highly Efficient Electron-Beam Source by Use of Carbon Nanotube for Image Recording", Collected Papers of Japan Hardcopy 97, The Imaging Society of Japan, p. 221-224, Jul. 1997 (with partial English translation).

Office Action mailed May 17, 2012 in U.S. Appl. No. 12/698,435.

Restriction Requirement mailed Apr. 16, 2012 in U.S. Appl. No. 12/699,349.

Notice of Allowance mailed Apr. 17, 2012 in U.S. Appl. No. 12/781,997.

U.S. Office Action mailed Jun. 18, 2012 in U.S. Appl. No. 12/698,435.

U.S. Office Action mailed Jun. 22, 2012 in U.S. Appl. No. 12/743,741.

U.S. Office Action mailed Jul. 19, 2012 in U.S. Appl. No. 12/698,342.

Restriction Requirement mailed Sep. 7, 2012 in U.S. Appl. No. 12/695,381.

U.S. Office Action mailed Sep. 28, 2012 in U.S. Appl. No. 12/696,905.

Office Action mailed Nov. 27, 2012 in U.S. Appl. No. 12/698,342.

Office Action mailed Mar. 14, 2013 in U.S. Appl. No. 12/696,905.

U.S. Appl. No. 13/835,133 filed Mar. 15, 2013, entitled "Electron Emitting Element, Electron Emitting Device, Light Emitting Device, Image Display Device, Air Blowing Device, Cooling Device, Charging Device, Image Forming Apparatus, Electron-Beam Curing Device, and Method for Producing Electron Emitting Element".

ELECTRON EMITTING ELEMENT, METHOD FOR PRODUCING ELECTRON EMITTING ELEMENT, ELECTRON EMITTING DEVICE, CHARGING DEVICE, IMAGE FORMING APPARATUS, ELECTRON-BEAM CURING DEVICE, LIGHT EMITTING DEVICE, IMAGE DISPLAY DEVICE, AIR BLOWING DEVICE, AND COOLING DEVICE

This Nonprovisional application claims priority under 35 U.S.C. §119(a) on Patent Application No. 2009-273724 filed in Japan on Dec. 1, 2009, the entire contents of which are hereby incorporated by reference.

TECHNICAL FIELD

The present invention relates to an electron emitting element for emitting electrons by application of a voltage, and a method for producing the electron emitting element. The present invention further relates to: an electron emitting device; a charging device; an image forming apparatus; an electron-beam curing device; a light emitting device; an image display device; an air blowing device; and a cooling device, each of which includes the electron emitting element.

BACKGROUND ART

A Spindt-type electrode and a carbon nanotube electrode (CNT) have been known as conventional electron emitting elements. Applications of such conventional electron emitting elements to, for example, the field of Field Emission Display (FED) have been studied. Such electron emitting elements are caused to emit electrons by tunnel effect resulting from formation of an intense electric field of approximately 1 GV/m that is produced by application of a voltage to a pointed section.

However, each of these two types of the electron emitting elements has an intense electric field in the vicinity of a surface of an electron emitting section. Accordingly, emitted electrons obtain a large amount of energy due to the electric field. This makes it easy to ionize gas molecules. However, cations generated in the ionization of the gas molecules are accelerated in a direction of a surface of the element due to the intense electric field and collide with the surface. This causes a problem of breakdown of the element due to sputtering.

Further, ozone is generated before ions are generated, because oxygen in the atmosphere has dissociation energy that is lower than ionization energy. Ozone is harmful to human bodies, and oxidizes various substances because of its strong oxidizing power. This causes a problem in that members around the element are damaged. In order to prevent this problem, the members used around the electron emitting element are limited to members that have high resistance to ozone.

Meanwhile, an MIM (Metal Insulator Metal) type and an MIS (Metal Insulator Semiconductor) type have been known as other types of electron emitting elements. These electron emitting elements are surface-emission-type electron emitting elements which accelerate electrons by utilizing quantum size effect and an intense electric field in the element so that electrons are emitted from a flat surface of the element. These electron emitting elements do not require an intense electric field outside the elements, because the electrons which are accelerated in respective electron acceleration layers inside the elements are emitted to the outside. Therefore, each of the MIM type and the MIS type electron emitting elements can overcome such problems that (i) the element is broken down by the sputtering which occurs due to ionization of gas molecules and (ii) ozone is generated, in the Spindt-type, CNT type, and BN type electron emitting elements.

Further, Patent Literature 1, made by the inventors of the present invention, discloses an electron emitting element including: an electrode substrate; a thin-film electrode; and an electron acceleration layer sandwiched between the electrode substrate and the thin-film electrode, which electron acceleration layer contains conductive fine particles and insulating fine particles. By application of a potential difference between the substrate electrode and the thin-film electrode, the electron emitting element emits electrons from the thin-film electrode.

The electron emitting element disclosed in Patent Literature 1 employs, as the electron acceleration layer, an insulating film in which the conductive fine particles, such as metal particles, are dispersed. Such an arrangement makes it possible to control a volt-ampere characteristic of the electron emitting element by adjusting (i) an amount of the conductive fine particles in the insulating film, and/or (ii) a dispersion state of the conductive fine particles in the insulating film. As disclosed in Patent Literature 1, the inventors of the present invention have succeeded in increasing the amount of emitted electrons by appropriately adjusting the amount of the conductive fine particles added to the insulating film, and/or the dispersion state of the conductive fine particles in the insulating film.

CITATION LIST

Patent Literature 1

Japanese Patent Application Publication, Tokukai, No. 2009-146891 A (Publication Date: Jul. 2, 2009)

SUMMARY OF INVENTION

Technical Problem

However, the electron emitting element disclosed in Patent Literature 1 requires a high driving voltage. There has been demand for the electron emitting element requiring a lower driving voltage.

A reduction in a voltage for driving the electron emitting element has the following advantages: first, it becomes possible to have a reduction in power consumption of the electron emitting element; and secondly, it becomes easy to drive the electron emitting element with a pulsed voltage having a high frequency due to a reduction in load with respect to a power supply for driving the electron emitting element. These advantages further lead to significant advantages, such as extension of a lifetime of the electron emitting element driven with the voltage, a reduction in power consumption of the electron emitting element, and a reduction in manufacture cost of a high-frequency pulse circuit.

The present invention is made in view of the problems. An object of the present invention is to provide an electron emitting element and the like, which electron emitting element (i) can emit electrons in an amount equal to or more than a conventional electron emitting element, with an applied voltage lower than that of the conventional electron emitting element, (ii) has a long lifetime, and (iii) can be produced at low cost.

Solution to Problem

In order to attain the object, the inventors of the present invention found, as a result of diligent study, that it becomes possible to allow an electron emitting element to emit electrons with a lower applied voltage by arranging the electron emitting element such that (i) an electron acceleration layer is formed by use of a dispersion solution in which conductive fine particles and insulating fine particles are dispersed, to which dispersion solution a crystalline electron transport agent is added, and (ii) the crystalline electron transport agent is crystallized in the electron acceleration layer. Based on the finding, the inventors of the present invention realized the present invention.

In other words, an electron emitting element of the present invention includes: an electrode substrate; a thin-film electrode facing the electrode substrate; and an electron acceleration layer sandwiched between the electrode substrate and the thin-film electrode, as a result of a voltage applied between the electrode substrate and the thin-film electrode, electrons being accelerated in the electron acceleration layer so as to be emitted from the thin-film electrode, the electron acceleration layer including (1) conductive fine particles which are made of a conductor and have a high resistance to oxidation, (2) insulating fine particles having an average particle diameter greater than an average particle diameter of the conductive fine particles, and (3) a crystalline electron transport agent, the crystalline electron transport agent being crystallized to crystals.

Advantageous Effects of Invention

According to the arrangement, the application of the voltage between the electrode substrate and the thin-film electrode generates a current path on an interface between the crystalline electron transport agent crystallized in the electron acceleration layer and fine particles in the electron acceleration layer. A part of an electric charge conducted in the current path becomes ballistic electrons due to an intense electric field formed by the applied voltage. The ballistic electrons are emitted from the thin-film electrode.

It is considered that (i) an electric property of a crystal grain boundary depends on consistency of a grain boundary and/or consistency of an interface, and (ii) the higher such consistency is, the lower an electrostatic potential barrier is in height. Therefore, according to the arrangement described above, it is considered that the electric charge can be conducted via a low electric potential barrier part, which is formed by the crystallization of the crystalline electron transport agent. That is, it becomes possible to form a current path with an applied voltage lower than an applied voltage of a conventional element.

Accordingly, in the arrangement in which the crystalline electron transport agent is crystallized in the electron acceleration layer, it is possible to emit electrons in an amount equal to or more than an amount with the conventional element, with an applied voltage lower than that of the conventional element. Such a reduction in the applied voltage can lead to extension of a lifetime of the electron emitting element, a reduction in power consumption, etc. Further, it becomes possible to provide the electron emitting element which can efficiently emit electrons, at low cost, without using an expensive material for the electron acceleration layer.

Here, a mechanism for generating ballistic electrons in the electron acceleration layer has a lot of unexplained points. However, is considered that the ballistic electrons are emitted from a surface of the electron emitting element in the following manner. A part of the electric charge conducted through the current path formed in the electron acceleration layer is accelerated due to an intense electric field which is locally formed, so as to be hot electrons (ballistic electrons). The hot electrons move along the electric field formed in the electron acceleration layer while being subjected to elastic collision repeatedly. A part of the hot electrons are transmitted trough the thin-film electrode serving as a surface of the electron emitting element, or passes thorough gaps of the thin-film electrode, so as to be emitted from the surface of the electron emitting element.

Further, an amount of the crystalline electron transport agent, used in the formation of the electron acceleration layer, should be set appropriately for the following reasons: (i) an excess amount of the crystalline electron transport agent added to the dispersion solution causes a current to flow so easily that it becomes impossible to apply a voltage necessary for the electron emission; (ii) on the other hand, an insufficient amount of the crystalline electron transport agent added to the dispersion solution makes it impossible to obtain a sufficient amount of a current, so that it becomes impossible to emit electrons. An appropriate amount of the crystalline electron transport agent should be set in accordance with parameters related to a resistance value of the electron emitting element (e.g. an amount of the conductive fine particles to be added, a layer thickness of the electron acceleration layer, and a film thickness of the resistance layer (later described)). Appropriate adjustment of the amount of the crystalline electron transport agent allows the electron emitting element to emit electrons sufficiently.

DESCRIPTION OF EMBODIMENTS

The following specifically explains embodiments and examples of an electron emitting element of the present invention and an electron emitting device of the present invention with reference to FIGS. 1 to 21. Note that embodiments and examples described below are merely specific examples of the present invention and by no means limit the present invention.

Embodiment 1

(Arrangements of Electron Emitting Element and Electron Emitting Device)

Figure 1:
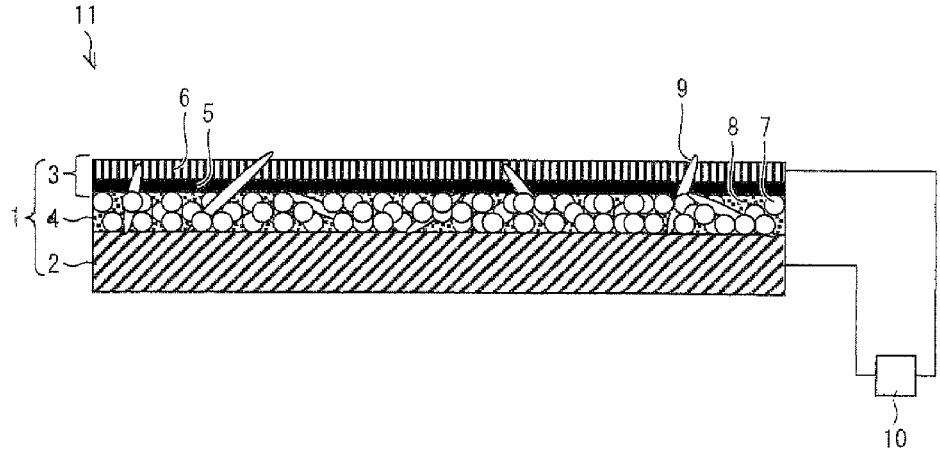
FIG. 1 is a view schematically illustrating an arrangement of an electron emitting device including an electron emitting element in accordance with an embodiment of the present invention.

FIG. 1 is a view schematically illustrating an arrangement of an electron emitting device 11 employing an electron emitting element 1 in accordance with one embodiment of the present invention. The electron emitting device 11 includes the electron emitting element 1 of the embodiment of the present invention, and a power supply 10 (see FIG. 1). The electron emitting element 1 includes an electrode substrate 2 serving as a lower electrode, a thin-film electrode 3 serving as an upper electrode, and an electron acceleration layer 4 sandwiched between the electrode substrate 2 and the thin-film electrode 3. Further, the electrode substrate 2 and the thin-film electrode 3 are connected to the power supply (power supply section) 10, so that a voltage can be applied between the electrode substrate 2 and the thin-film electrode 3 which are provided so as to face each other. The electron emitting element 1 applies a voltage between the electrode substrate 2 and the thin-film electrode 3 so that a current flows between the electrode substrate 2 and the thin-film electrode 3, that is, in the electron acceleration layer 4. A part of the current serves as ballistic electrons due to an intense electric field formed by the applied voltage. The ballistic electrons pass (transmit) through the thin-film electrode 3 or go through (i) holes (gaps) of the thin-film electrode 3, which are formed due to an influence of gaps between insulating fine particles, or (ii) steps between the insulating fine particles. Then, the ballistic electrons are emitted to the outside.

The electrode substrate 2 serving as the lower electrode acts as not only an electrode but also a supporting member of the electron emitting element Accordingly, the electrode substrate 2 is not specifically limited in material as long as the material has a sufficient strength, excellent adhesiveness with respect to a substance in direct contact with the material, and sufficient electrical conductivity. Examples of the electrode substrate 2 include: metal substrates made of, for example, SUS, Al, Ti, and Cu; and semiconductor substrates made of, for example, Si, Ge, and GaAs. Further, the electrode substrate 2 may be such that an insulator substrate, such as a glass substrate or a plastic substrate, having a surface (an interface between the electrode substrate 2 and the electron acceleration layer 4) to which an electrically conductive material, such as a metal, is attached as an electrode. A constituent material of the electrically conductive material is not specifically limited as long as a thin film of a material excellent in electric conductivity can be formed by magnetron sputtering or the like. Note that, if a steady operation of the electron emitting element in the atmosphere is desired, a conductor having a high resistance to oxidation is preferably used and a noble metal is more preferably used for the constituent material. An ITO thin-film which is widely used as an electrically conductive oxide material for a transparent electrode is also applicable. Alternatively, it is possible to use, as the lower electrode, a metal thin film obtained by first forming a Ti film of 200 nm on a surface of a glass substrate and then forming a Cu film of 1000 nm on the Ti film, because a strong thin film can be formed, In this case, materials and values are not specifically limited to those described above.

The thin-film electrode 3 has a multilayer structure constituted by a resistive layer 5 and a metal layer 6 so as to limit an amount of a current flowing through the electron acceleration layer 4.

Examples of the resistive layer 5 encompass an amorphous carbon film and a nitride film. In the case where the amorphous carbon film is used as the resistive layer 5, the resistive layer 5 is such that clusters (aggregates each constituted by hundreds of atoms), each having a graphite structure having so-called SP2 hybrid orbitals, are disorderly accumulated. The graphite itself is a material having excellent electrical conductivity. However, the electric conduction between the clusters are poor due to the accumulation state of the clusters. Accordingly, the amorphous carbon film functions as the resistive layer 5.

In the case where the nitride film is used as the resistive layer 5, the resistive layer 5 is such that $SiN_2$, $TaN_2$, or the like, is formed by a sputtering method, for example. Note that the amorphous carbon film is more preferable than the nitride film, in terms of a simple production process, a processing time, resistivity with respect to an increase in temperature, etc.

The metal layer 6 is made of a metal material. The metal material is not specifically limited as long as the material makes it possible to apply a voltage. A material which has a low work function and from which a thin-film can be formed is expected to provide a greater effect, in view of emitting, with a minimum energy loss, electrons which have high energy due to acceleration within the electron acceleration layer 4. Examples of such a material encompass: gold; silver; tungsten; titanium; aluminum; and palladium, each of which has a work function in a range of 4 eV to 5 eV. Among these materials, in particular, in consideration of an operation under an atmospheric pressure, the best material is gold which is free from oxide or sulfide formation reaction. Further, silver, palladium, or tungsten each of which has a relatively small oxide formation reaction is also applicable material that can be used without any problem.

Further, a film thickness of the thin-film electrode 3 is a very important factor for causing efficient emission of electrons from the electron emitting element 1 to the outside. The thin-film electrode 3 preferably has a film thickness in a range of 15 nm to 100 nm. The minimum film thickness of the thin-film electrode 3 is 10 nm, for causing the metal layer 6 of the thin-film electrode 3 to work properly as a planar electrode. A film thickness of less than 10 nm cannot ensure electrical conduction. Further, in order to cause the resistance layer 5 made of the amorphous carbon film to properly function as the resistance member, it is necessary for the resistance layer 5 to have a thickness of 5 nm or more.

On the other hand, the maximum film thickness of the thin-film electrode 3 is 100 nm, for emitting electrons from the electron emitting element 1 to the outside. In a case where the film thickness is more than 100 nm, an amount of ballistic electrons emitted from the electron emitting element 1 is significantly reduced. It is considered that the amount of the emitted ballistic electron is reduced due to the following reason: (i) the ballistic electrons are absorbed by the thin-film electrode 3, and/or (ii) the ballistic electrons are reflected back by the thin-film electrode 3 toward the electron acceleration layer 4 and are recaptured in the electron acceleration layer 4.

Figure 2:
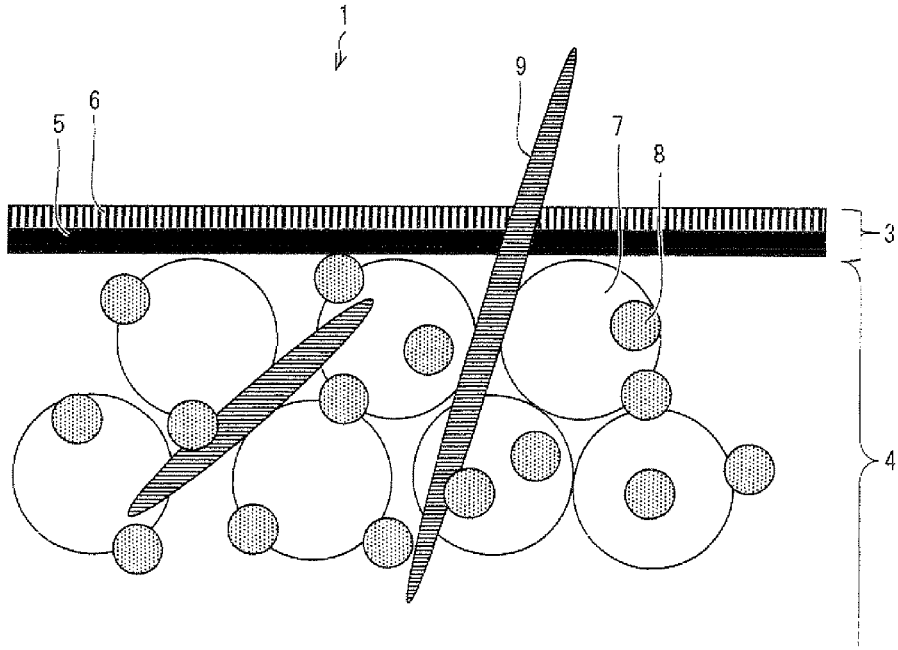
FIG. 2 is a schematic enlarged view of the vicinity of an electron acceleration layer of the electron emitting element of the electron emitting device illustrated in FIG. 1.

The electron acceleration layer 4 includes: conductive fine particles 8, which are made of a conductive material and have a high resistance to oxidation; insulating fine particles 7 having a larger average particle diameter than that of the conductive fine particles 8; and a crystalline electron transport agent 9. FIG. 2 is an enlarged view of the vicinity of the electron acceleration layer 4 of the electron emitting element 1 illustrated in FIG. 1.

A material of the insulating fine particles 7 is not specifically limited as long as the material has an insulating property. For example, $SiO_2$, $Al_2O_3$, and $TiO_2$ are practically used. Further, fine particles made of an organic polymer can be used as the material of the insulating fine particles 7. Examples of such fine particles made of an organic polymer are cross-linked fine particles (SX 8743) made of stylene/divinylbenzene manufactured and marketed by JSR Corporation, or Fine Sphere series which are styrene acryl fine particles manufactured and marketed by NIPPON PAINT Co., Ltd.

Further, particles that may be used as the insulating fine particles 7 can include (i) two or more different sorts of particles made of materials different from each other, (ii) particles having different peaks in diameter, or (iii) one sort of particles whose distribution of diameters is broad. The insulating fine particles 7 preferably have an average particle diameter in a range of 10 nm to 1000 nm, more preferably in a range of 10 nm to 200 nm.

The conductive fine particles 8 can be made of any kind of conductor, in view of an operation principle for generating ballistic electrons. Note, however, that the material should be a conductor having a high resistance to oxidation so that oxidation degradation at the time of an operation under the atmospheric pressure can be prevented. It is preferable that the conductive fine particles 8 are made of a notable metal, such as gold, silver, platinum, palladium, or nickel. The conductive fine particles 8 can be produced by using a known fine particle production method such as a sputtering method or a spray heating method. It is also possible to use commercially available conductive fine particle powder such as silver nanoparticles manufactured and marketed by Applied Nano Particle Laboratory Co. A principle of generating ballistic particles will be described later.

In the present embodiment, because control of electric conductivity is required, an average particle diameter of the conductive fine particles 8 has to be smaller than that of the insulating fine particles 7. The conductive fine particles 8 preferably have an average particle diameter in a range of 3 nm to 10 nm. In a case where, as described above, the average particle diameter of the conductive fine particles 8 is arranged to be smaller than that of the insulating fine particles 7 and preferably in a range of 3 nm to 10 nm, a conductive path made of the conductive fine particles 8 is not formed in a fine particle layer (the electron acceleration layer 4). As a result, dielectric breakdown becomes difficult to occur in the fine particle layer. The principle has a lot of unexplained points; however, the ballistic electrons are efficiently generated by use of the conductive fine particles 8 whose average particle diameter is within the above range.

Note that a conductive fine particle 8 may be surrounded by a small insulating material that is an insulating material whose size is smaller than the conductive fine particle 8. This small insulating material can be an adhering substance which adheres to a surface of the conductive fine particle 8. Further, the adhering substance may be an insulating coating film that coats the surface of the conductive fine particle 8 and that is made as an aggregate of particles whose average particle diameter is smaller than that of the conductive fine particle 8. In view of the operation principle for generating ballistic electrons, any insulating material can be used as the small insulating material. However, in a case where the insulating material whose size is smaller than that of the conductive fine particle 8 is the insulating coating film coating the surface of the conductive fine particle 8 and an oxide film of the conductive fine particle 8 is used as the insulating coating film, a thickness of the oxide film may be increased to a thickness larger than a desired thickness due to oxidation degradation in the atmosphere. For the purpose of preventing the oxidation degradation at the time of an operation under the atmospheric pressure, the insulating coating film is preferably made of an organic material. Examples of the organic material include: alcoholate, aliphatic acid, and alkanethiol. A thinner insulating coating film is more advantageous.

Figure 3:
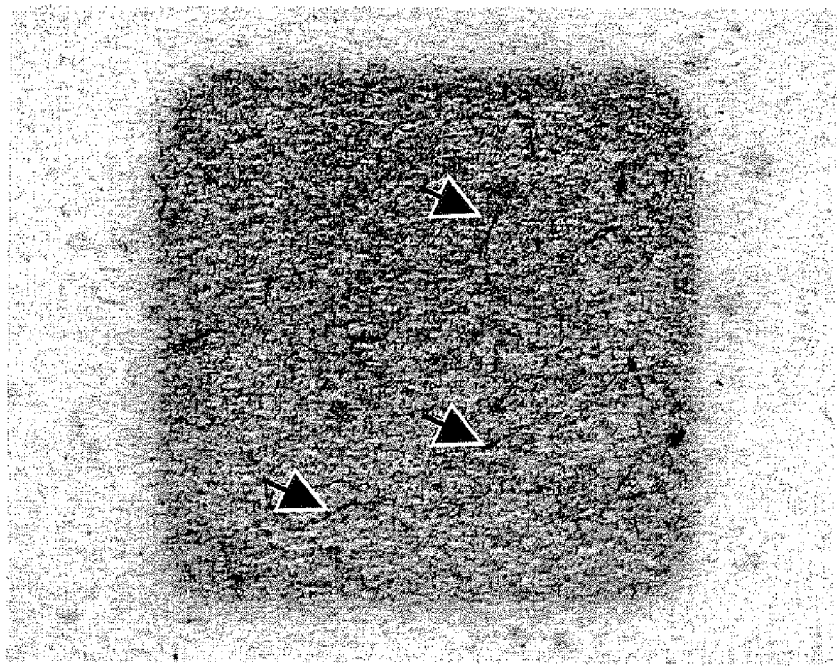
FIG. 3 is an enlarged photograph showing a state of a surface of the electron emitting element illustrated in FIG. 1.

The crystalline electron transport agent 9 is a material that is soluble in a dispersion solution in which the insulating fine particles 7 and the conductive fine particles 8 are dispersed. At a time immediately after the electron acceleration layer 4 is formed, the crystalline electron transport agent 9 is not in a form of needle-shaped crystals which are illustrated in FIGS. 1 and 2, for example. However, the crystalline electron transport agent 9 is turned into a crystallized structure illustrated in FIGS. 1 and 2, as the electron acceleration layer 4 is left at rest at a room temperature for dozens of hours and crystallization of the crystalline electron transport agent 9 develops. The crystallization of the crystalline electron transport agent 9 develops randomly in terms of a position where the crystallization takes place and a direction in which the crystallization develops. For example, the crystalline electron transport agent 9 may grow in a horizontal direction in the electron acceleration layer 4, or may grow so as to penetrate a surface of the electron acceleration layer 4 in a vertical direction. FIG. 3 is a photograph of the surface of the electron emitting element 1 in which the crystalline electron transport agent 9 has been re-crystallized. In FIG. 3, a square part shown at the center is the thin-film electrode 3, in which the crystalline electron transport agent 9 which has been re-crystallized is in a form of a plurality of lines apart from each other. In FIG. 3, the crystalline electron transport agent 9 which has been re-crystallized is indicated by an arrow.

According to the present invention, the crystalline electron transport agent 9 is re-crystallized in the electron acceleration layer 4 so as to exhibit its electron transport ability. It has been considered that (i) an electric property of a crystal grain boundary depends on consistency of a grain boundary or an interface, and (ii) the higher the consistency is, the lower an electrostatic potential barrier is in height. In the arrangement of the electron emitting element 1 of the present embodiment, an electric charge is conducted via the crystals of the crystalline electron transport agent 9, particularly, via a lower electric potential barrier part which is incidentally formed due to the growth of the crystalline electron transport agent 9 into needle-shaped crystals. Therefore, it can be considered that in a case where the crystalline electron transport agent 9 has been crystallized, it becomes possible to form a current path with a lower applied voltage as compared with a case where the crystalline electron transport agent 9 has not been crystallized. Such a crystalline electron transport agent 9 may be made of, but not limited to, diphenoquinone.

The addition of the crystalline electron transport agent 9 to the electron acceleration layer 4 is carried out in such a manner that the crystalline electron transport agent 9 is added to the dispersion solution in which the insulating fine particles 7 and the conductive fine particles 8, constituting the electron acceleration layer 4, are dispersed in a dispersion solvent, which dispersion solution constitutes the electron acceleration layer 4. Details of how to add the crystalline electron transport agent 9 to the dispersion solution will be described later. In the present embodiment, the crystalline electron transport agent 9 only has to be dissolved in the dispersion solution. Note, however, that in a case where the crystalline electron transport agent 9 is dissolved in the dispersion solvent before the insulating fine particles 7 and the conductive fine particles 8 are dispersed in the dispersion solvent, viscosity of the solvent increases. In this case, the dispersion of the insulating fine particles 7 and the conductive fine particles 8 tends to require a longer time. Therefore, it is preferable to add the crystalline electron transport agent 9 to the dispersion solution after the insulating fine particles 7 and the conductive fine particles 8 are dispersed in the dispersion solvent.

In order that the crystalline electron transport agent 9 exhibits its electron transport ability, it is necessary to cause intermolecular sites of the crystalline electron transport agent 9 to function as electron hopping sites. The electron transport ability and an additive concentration of the crystalline electron transport agent 9 are in a proportional relationship with each other. Further, an amount of the crystalline electron transport agent 9 to be added depends on a structure of the electron acceleration layer 4 functioning as a base material. As disclosed in Patent Literature 1 described above, the electron acceleration layer 4 is constituted by the insulating fine particles 7 and the conductive fine particles 8 so that a current flows in the electron emitting element 1. In a case where, with respect to a whole amount of particles (the insulating fine particles 7 and the conductive fine particles 8) in the electron acceleration layer 4, a mass ratio of the insulating fine particles 7 to the conductive fine particles 8 is set to be 8:2, for example, addition of only a small amount of the crystalline electron transport agent 9 causes an increase in resistance (due to the addition of the polymer), rather than induction of an electron transport function of the electron transport agent 9. As a result, the current flowing through the electron acceleration layer 4 tends to decrease. As the amount of the crystalline electron transport agent 9 to be added is increased, the current in the element flowing through the electron acceleration layer 4 tends to increase accordingly.

Further, the crystalline electron transport agent 9 is re-crystallized in the electron acceleration layer 4 so as to ultimately achieve an increase in the current in the element.

In a case where the amount of the crystalline electron transport agent 9 to be added is merely increased, the current flows selectively and intensively between the molecules of the crystalline electron transport agent 9, as described above. In this case, the electrons are not accelerated at an intense electric field part (i.e. a resistance part functioning as a part for accelerating the electrons at a micro level), which is considered as being formed on an intermediate point in the current path. As a result, no ballistic electrons are generated. On the other hand, in a case where the crystalline electron transport agent 9 is re-crystallized, the current in the element is increased. In this case, the ballistic electrons can be highly efficiently generated by the current flowing, via the crystal grain boundary, through the interface between the insulating fine particles 7 and the conductive fine particles 8.

The crystallization of the crystalline electron transport agent 9 can occur during a process in which a solution in which the crystalline electron transport agent 9 is dissolved penetrates into a great number of holes of the insulating fine particles 7, and gradually vaporizes the solvent under the atmosphere pressure at the room temperature.

An amount of the crystals resulting from the crystallization and a current property of the electron acceleration layer 4 are in a simple proportional relationship with each other. As a matter of course, the more the crystals are generated, the more the current in the element flows through the electron acceleration layer 4. However, a withstand pressure with respect to repeated application of the voltage tends to be reduced simultaneously, so that a short circuit can be easily generated in the element.

As described above, there is an appropriate amount of the crystalline electron transport agent 9 to be added to the electron acceleration layer 4, and it is preferable to set an appropriate value in accordance with the amount of the current flowing in the electron emitting element 1. Meanwhile, the amount of the crystalline electron transport agent 9 to be added largely depends on material parameters related to the electron emitting element 1, so that it is not always the best way to determine the appropriate amount in the manner described above. However, as described later, under a condition where (i) the dispersion solution in which the insulating fine particles 7 and the conductive fine particles 8 are dispersed is dropped, and (ii) the electron acceleration layer 4 is formed by a spin coat method, it is preferable to add the crystalline electron transport agent 9 in an amount described below. It is preferable to set a mass of the crystalline electron transport agent 9 to be approximately 5% with respect to that of the insulating fine particles 7 constituting the electron acceleration layer 4. Further, it is preferable to set the mass of the crystalline electron transport agent 9 to be 0.82% with respect to that of the solvent.

It is also necessary for the electron acceleration layer 4 to have such a thickness that (i) the electron acceleration layer 4 can have an even layer thickness, and (ii) a resistance of the electron acceleration layer 4 can be adjusted in a direction of the layer thickness of the electron acceleration layer 4. In consideration of these conditions, the electron acceleration layer 4 preferably has a layer thickness in a range of 12 nm to 6000 nm, more preferably in a range of 300 nm to 1000 nm.

The voltage supplied from the power supply 10 may be a DC voltage. Note, however, that it is preferable that the voltage supplied from the power supply 10 is a pulsed voltage. The electron emitting element 1 has a more stable electron emitting property in response to the application of the pulsed voltage than the DC voltage in a case where the electron emitting element 1 is continuously driven. This is because the following reasons.

Due to the crystalline electron transport agent 9 which has been crystallized, the current can highly easily flow in the electron emitting element 1. Even if the thin-film electrode 3 has the multilayer structure constituted by the resistance layer 5 and the metal layer 6 as described above, that is, even if the resistance layer 5 is provided between the electron acceleration layer 4 and the metal layer 6, it is impossible to prevent an increase in the current in the element due to long-time continuous driving. It is considered that the increase in the current in the element with application of the DC voltage is caused by gradual destruction of a part functioning as a resistance component in the current path. The increase in the current in the element ultimately causes a short-circuit of the element so that the electron emission is interrupted. In order to suppress such an increase in the current in the element, the pulsed voltage is applied to the element from the power supply 10. With the application of the pulsed voltage, it is possible to prevent the destruction of the part functioning as the resistance component in the current path.

Therefore, with the structure of the electron emitting element 1 and the application of the pulsed voltage, it becomes possible to provide the electron emitting device 11 which can stably emit electrons with a low voltage.

(Method of Producing Electron Emitting Element)

The following explanation deals with an embodiment of a method for producing the electron emitting element 1.

First, insulating fine particles 7 and conductive fine particles 8 are added to a dispersion solvent in this order, and are dispersed in the solvent by use of an ultrasonic dispersion device. Then, a crystalline electron transport agent 9 is added to the resultant solution. The resultant solution is further subjected to a dispersion process carried out by use of the ultra dispersion device again. As a result, a fine particle dispersion solution A is obtained. Note that a dispersion method is not particularly limited, and the dispersion can be carried out without such an ultrasonic dispersion device.

Here, the dispersion solvent is not particularly limited as long as the dispersion solvent (i) allows the crystalline electron transport agent 9 to be dissolved in the dispersion solvent, and (ii) can be vaporized after the dispersion solvent is applied to a substrate. Examples of the dispersion solvent encompass toluene, benzene, xylene, and hexane.

Then, the fine particle dispersion solution A produced as described above is applied to an electrode substrate 2 so as to form an electron acceleration layer 4 (electron acceleration layer forming step). The fine particle dispersion solution A can be applied to the electrode substrate 2 by, for example, a spin coat method. In this case, the fine particle dispersion solution A is dropped on the electrode substrate 2, and then a thin film, which is to be the electron acceleration layer 4, is formed by the spin coat method. Steps of (i) the dropping of the fine particle dispersion solution A, (ii) the film forming by the spin coat method, and (iii) drying the thin film are repeated a couple of times so that the electron acceleration layer 4 having a predetermined film thickness can be formed.

Note that how to form the electron acceleration layer 4 is not limited to the spin coat method, and can be a dropping method, a spray coat method, or the like.

After the electron acceleration layer 4 is formed, a thin-film electrode 3 is formed on the electron acceleration layer 4 (thin-film electrode forming step). As described above, the thin-film electrode 3 has a multilayer structure constituted by a resistance layer 5 and a metal layer 6. In a case where an amorphous carbon film is used as the resistance layer 5, it is possible to form the resistance layer 5 by a vapor-deposition method, for example. Further, in a case where a nitride film is used as the resistance layer 5, it is possible to form the resistance layer 5 by a spattering method, for example.

The metal layer 6 can be formed by a magnetron sputtering method. Note, however, that how to form the metal layer 6 is not limited to the magnetron sputtering method, and can be the vapor-deposition method, an inkjet method, the spin coat method, or the like.

At a time immediately after the electron acceleration layer 4 is produced, the crystalline electron transport agent 9 contained in the electron acceleration layer 4 is not in a form of crystals. However, the crystalline electron transport agent 9 is crystallized (re-crystallized) while being left at rest under a natural condition (crystallization step). Here, in a case where the crystalline electron transport agent 9 is made of a material which is to be crystallized into needle-shaped crystals, the crystalline electron transport agent 9 may be crystallized so as to penetrate the electron acceleration layer 4 in a layer thickness direction of the electron acceleration layer 4. In this case, the crystalline electron transport agent 9 which has been crystallized exists inside/outside the electron acceleration layer 4.

Example

In the following Example, first, the descriptions deal with a result of an experiment for finding (i) how the current in the electron emitting element 1 changes as the amount of the crystalline electron transport agent 9 to be added is changed, and (ii) how the amount of emitted electrons changes as the amount of the crystalline electron transport agent 9 to be added is changed, in a case where the crystalline electron transport agent 9 is in an amorphous state in the electron acceleration layer 4 (the crystalline electron transport agent 9 has not been crystallized). Secondly, the descriptions deal with a result of measurement of (i) the current in the electron emitting element 1 and (ii) the amount of emitted electrons, which measurement was carried out for each of (i) the electron emitting element 1 in which the crystalline electron transport agent 9 was in the amorphous state, and (ii) the electron emitting element 1 in which the crystalline electron transport agent 9 had been crystallized. Further, in order to find out a role of the thin-film electrode 3, another experiment was carried out.

First, the following description deals with a detailed condition for producing an electron emitting element Into a 10 mL reagent bottle, 1.0 g of an n-hexane solvent was supplied. Then, 0.16 g of silica particles was supplied into the reagent bottle as the insulating fine particles 7. The reagent bottle was subjected to a dispersion process by use of an ultrasonic dispersion device, so that the silica fine particles were dispersed in the solvent. In the present Example, the silica fine particles were fumed silica 0413 (manufactured by Cabot Corporation, average particle diameter: 50 nm), whose surface was processed with hexamethyldisilazane. The dispersion process was carried out by use of the ultrasonic dispersion device for 10 minutes. As a result, the silica fine particles were dispersed in the n-hexane solvent so that the n-hexane solvent turned into milky-white in color. Next, 0.04 g of silver nanoparticles were supplied into the reagent bottle as the conductive fine particles 8. Then, the resultant solution was subjected to the dispersion process by use of the ultrasonic dispersion device for 5 minutes so that a fine particle dispersion solution was produced. As the silver nanoparticles, silver nanoparticles (manufactured by Applied Nano Particle Laboratory Co., an average particle diameter: 10 nm) each being coated by an insulator of alcoholate were used.

The fine particle dispersion solution was produced in three reagent bottles independently. Into the three reagent bottles, (i) no crystalline electron transport agent 9, (ii) 0.082 g of the crystalline transport agent 9, and (iii) 0.04 g of the crystalline electron transport agent 9 were added, respectively. As the crystalline electron transport agent 9, diphenoquinone powder (T1503 (3,3',5,5'-Tetra-tert-butyl-4,4'-diphenoquinone), manufactured by Tokyo Chemical Industry Co., Ltd.) was used. Then, with respect to the resultant solution in each of the three reagent bottles, the dispersion process was carried out by use of the ultrasonic dispersion device for 5 minutes again, so that the crystalline electron transport agent 9 was dissolved into the fine particle dispersion solution in each of the three reagent bottles.

The electrode substrate 2 was such that a Ti film having a thickness of 200 nm was formed on a glass substrate of a size of 24 mm×24 mm, and a Cu film having a thickness of 1000 nm was formed on the Ti film. Each of the three fine particle dispersion solutions produced as described above (one solution without the diphenoquinone powder, and two solutions with the diphenoquinone powder) was dropped on a surface of the glass substrate having the electrode, independently. Then, for each of the three solutions, a fine particle layer, which was to be the electron acceleration layer 4, was produced by the spin coat method. The condition for forming the film by the spin coat method was such that (i) the fine particle dispersion solution was dropped on the surface of the substrate while the rotation was carried out for 5 seconds at 500 RPM, and then (ii) the rotation was carried out for 10 seconds at 3000 RPM. The condition described above was carried out only once so that a single fine particle layer was accumulated on the grass substrate. Then, the glass substrate was left for one hour in the atmosphere at a room temperature, so as to be dried naturally. The resultant fine particle layer, i.e. the electron acceleration layer 4, had a film thickness of approximately 700 nm.

The crystalline electron transport agent 9 was not re-crystallized in either (i) the electron acceleration layer 4 formed by use of the solution in which 0.082 g of the crystalline electron transport agent 9 was dissolved, and (ii) the electron acceleration layer 4 formed by use of the solution in which 0.04 g of the crystalline electron transport agent was dissolved.

In the electron emitting element 1, the thin-film electrode 3 constituted by the resistance layer 5 and the metal layer 6 is formed on the electron acceleration layer 4. However, in the present experiment, only the metal layer 6 was formed so as to clarify a relationship between the amount of the crystalline electron transport agent 9 to be added and a current property of the electron acceleration layer 4. The metal layer 6 was formed from a gold/palladium target (Au—Pd) by use of a magnetron sputtering device, so as to have a film thickness of 50 nm and a film area of 0.01 $cm^2$.

Figure 4:
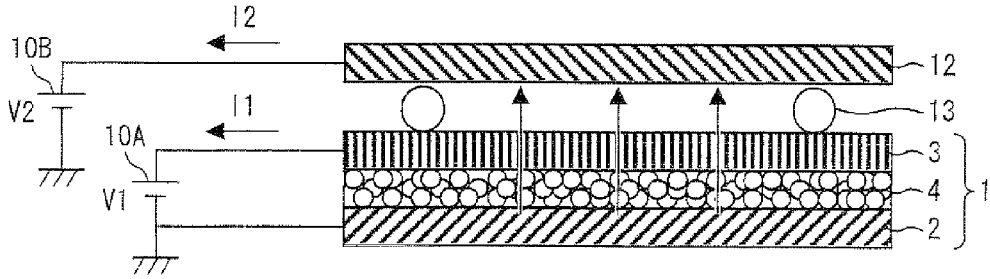
FIG. 4 is an explanatory view illustrating a measurement system used in an electron emission experiment carried out with respect to an electron emitting element.

With respect to each of the three electron emitting element 1, produced as described above (produced with the use of (i) no diphenoquinone powder, (ii) 0.082 g of diphenoquinone powder, and 0.04 g of diphenoquinone powder, respectively), an electron emitting experiment was carried out by use of a measurement system illustrated in FIG. 4.

FIG. 4 illustrates the measurement system used in the electron emitting experiment. In the measurement system illustrated in FIG. 4, a counter electrode 12 is arranged so as to face the thin-film electrode 3 of the electron emitting element 1 with insulating spacers 13 (diameter: 1 mm) therebetween. A power supply 10A applies a voltage V1 between the electrode substrate 2 and the thin-film electrode 3 of the electron emitting element 1, while a power supply 10B applies a voltage V2 to the counter electrode 12. A current I1, flowing between the thin-film electrode 3 and the power source 10A, is measured as the current flowing in the element, and a current I2, flowing between the counter electrode 12 and the power supply 10B, is measured as the electron emission current. The electron emitting experiment was carried out under such a condition that the measurement system described above was placed in vacuum at $1\times10^{-8}$ ATM.

Figure 5:
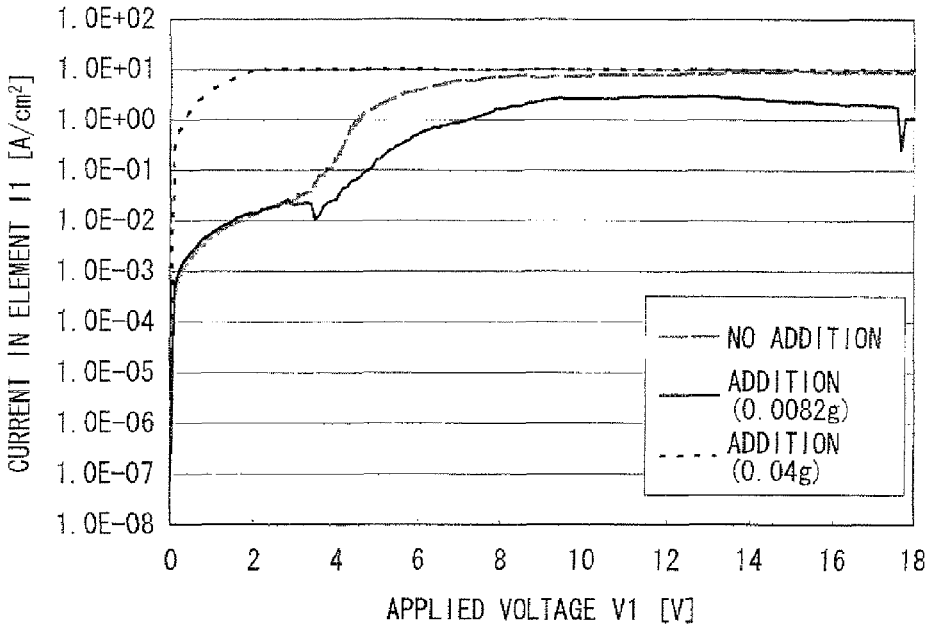
FIG. 5 is a graph showing a result of measurement of a current flowing in each of three electron emitting elements, (i) each of which includes the electron acceleration layer produced by use of a fine particle dispersion solution to which a crystalline transport agent is added, and (ii) which contains (a) no crystalline electron transport agent, (b) 0.0082 g of the crystalline electron transport agent, and (c) 0.04 g of the crystalline electron transport agent, respectively.

FIG. 5 shows a result of the measurement of the current I1 in each of the three electron emitting elements Here, the applied voltage V1 was increased from 0 V to 18 V in stages, while the applied voltage V2 was maintained to be 100 V. Further, FIG. 6 shows a result of the measurement of the electron emission current I2 emitted from each of the three electron emitting elements 1.

As shown in FIG. 5, the current I1 in the element [unit: A/$cm^2$] changed in accordance with a change in the amount of the added crystalline electron transport agent 9. As described above, the electron emitting element 1 has such an arrangement that the current in the element flows and is emitted from the electron emitting element 1 even if the electron emitting element 1 does not contain the crystalline electron transport agent 9. As compared with, as a standard, the electron emitting element 1 to which no crystalline transport agent 9 was added, the electron emitting element 1 to which 0.0082 g (a small amount) of the crystalline electron transport agent 9 was added had a reduction in the current I1 in the element. It is considered that the reduction was caused because (i) the crystalline electron agent 9 had such an additive concentration that the electron transport ability of the crystalline electron transport agent 9 could not sufficiently function, and (ii) the crystalline electron transport agent 9 functioned as a resistive element.

On the other hand, in the electron emitting element 1 to which 0.04 g of the crystalline electron transport agent 9 was added, the current I1 in the element was increased to an amount more than an amount of a current supplied to the measurement system, so that the short-circuit occurred. This is because the crystalline electron transport agent 9 sufficiently exhibited its electron transport ability.

Figure 6:
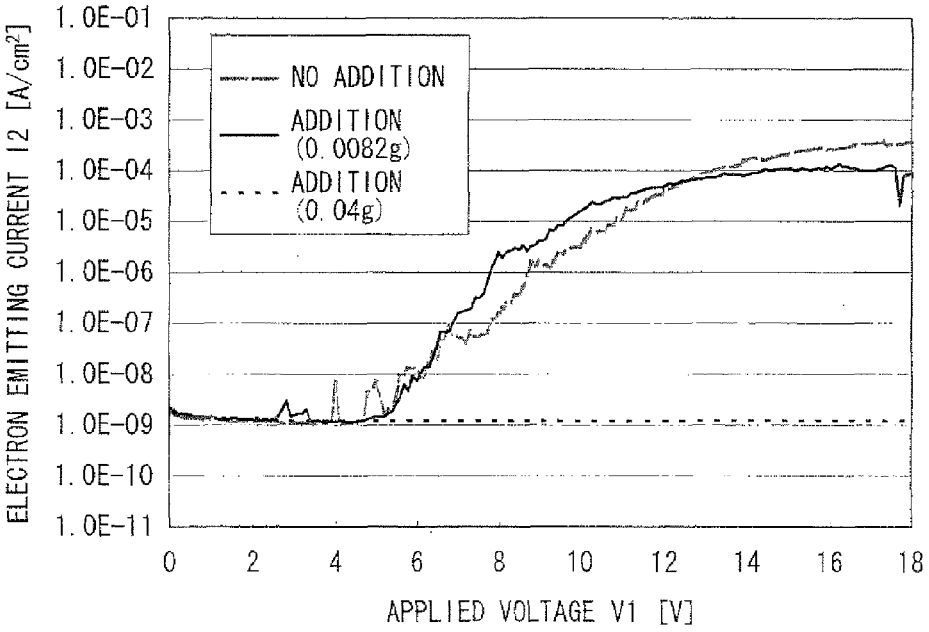
FIG. 6 is a graph showing a result of measurement of an electron emitting current of each of three electron emitting elements, (i) each of which includes the electron acceleration layer produced by use of a fine particle dispersion solution to which a crystalline transport agent is added, and (ii) which contains (a) no crystalline electron transport agent, (b) 0.0082 g of the crystalline electron transport agent, and (c) 0.04 g of the crystalline electron transport agent, respectively.

In the same manner, as shown in FIG. 6, the electron emission current I2 [unit: A/cm$^2$] also changed in accordance with a change in the amount of the added crystalline electron transport agent 9. As compared with, as a standard, the electron emitting element 1 to which no crystalline electron transport agent 9 was added, the electron emitting element 1 to which 0.0082 g of the crystalline electron transport agent 9 was added had a reduction in the electron emission current I2 with an applied voltage V1 of 12 V or more. In the electron emitting element 1 to which 0.04 g of the crystalline electron transport agent 9 was added, the electron emission current I2 could not be measured due to the short-circuit of the current I1 in the element.

Figure 7:
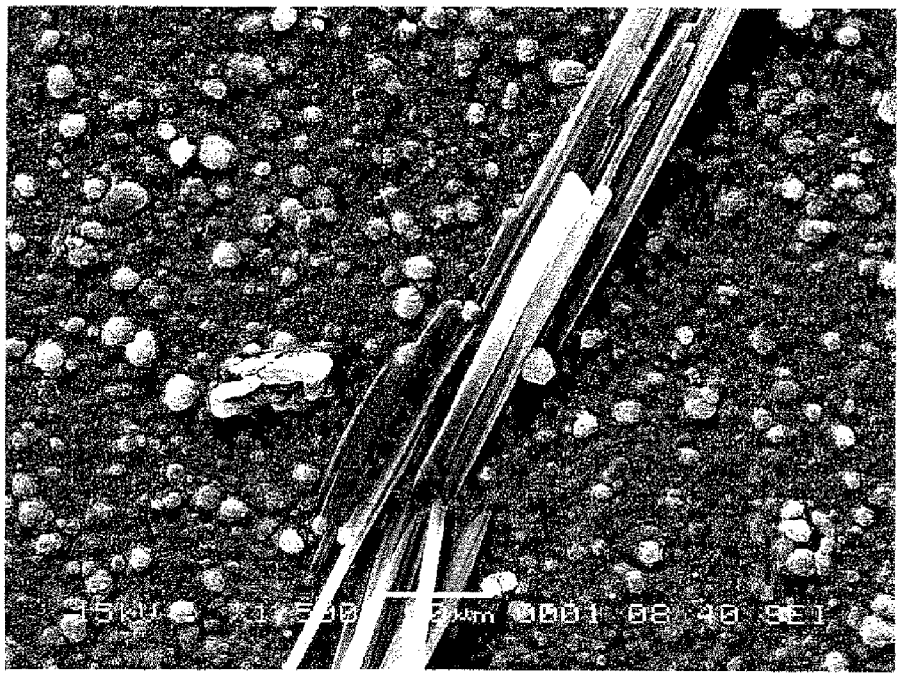
FIG. 7 is an SEM photograph, showing a state of a surface of the electron emitting element illustrated in FIG. 1.

Next, in the same manner as described above, the fine particle dispersion solution to which 0.0082 g of the crystalline electron transport agent 9 was added was produced and the electron acceleration layer 4 was formed. After the electron acceleration layer 4 was formed, the electron acceleration layer 4 was left for three days under a natural condition at the room temperature so as to be dried naturally. As a result, the crystallized electron transport agent 9 was re-crystallized. The re-crystallization of the crystalline electron transport agent 9 was confirmed such that needle-shaped crystals were confirmed visually and also under an SEM. FIG. 7 is an SEM photograph showing the needle-shaped crystals. FIG. 7 shows a state where crystals of diphenoquinone, which are the crystalline electron transport agent 9, grew so as to penetrate a surface of the electron acceleration layer (fine particle layer) 4.

On the electron acceleration layer 4 in which the crystalline transport agent 9 was re-crystallized, the thin-film electrode 3 constituted by the resistance layer 5 and the metal layer 6 was formed. As the resistance layer 5, the amorphous carbon film was formed by the vapor deposition method, so as to have a film thickness of 15 nm and a film area of 0.01 cm$^2$. Then, the metal layer 6 was formed from the gold/palladium target (Au—Pd) by use of the magnetron sputtering device, so as to have a film thickness of 50 nm and a film area of 0.01 cm$^2$. In this manner, the resistance layer 5 and the metal layer 6 were formed on the electron acceleration layer 4 such that the resistance layer was in contact with the electron acceleration layer 4.

Figure 8:
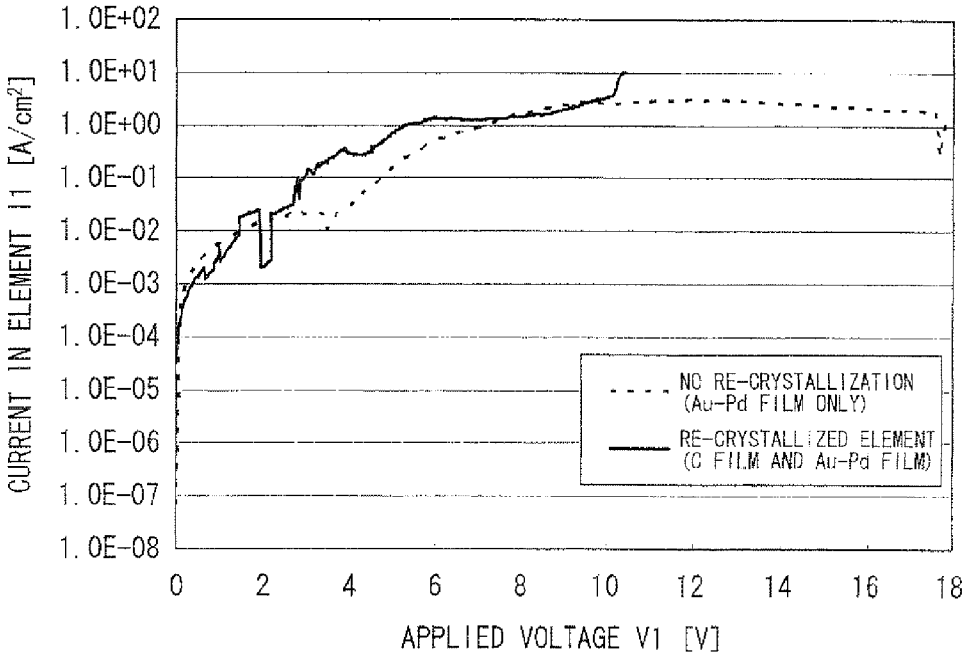
FIG. 8 is a graph showing a result of measurement of the current flowing in the electron emitting element including the electron acceleration layer produced by use of the fine particle dispersion solution to which 0.0082 g of the crystalline electron transport agent is added, which measurement was carried out before/after the crystalline electron transport agent was re-crystallized in the electron acceleration layer.

FIG. 8 shows a result of the measurement of the current I1 [unit: A/cm$^2$] in the electron emitting element 1 to which 0.0082 g of the crystalline electron transport agent 9 was added. The measurement was carried out before/after the crystalline electron transport agent 9 was re-crystallized in the electron emitting element 1. Here, in the electron emitting element 1 in which the crystalline electron transport agent 9 had not been re-crystallized, only the metal layer 6 made of gold and palladium, was formed on the electron acceleration layer 4. On the other hand, in the electron emitting element 1 in which the crystalline electron transport agent 9 had been re-crystallized, the resistance layer 5 made of the amorphous carbon film, and the metal layer 6 made of gold and palladium were formed on the electron acceleration layer 4 such that the resistance layer 5 was in contact with the electron acceleration layer 4. FIG. 8 shows that, as compared with the electron emitting element 1 in which the crystalline electron transport agent 9 had not been re-crystallized (no re-crystallization), the electron emitting element in which the crystalline electron transport agent 9 had been re-crystallized (re-crystallized element) had an increase in the current I1 in the element by approximately a single digit with an applied voltage V1 of 3 V or more.

Figure 9:
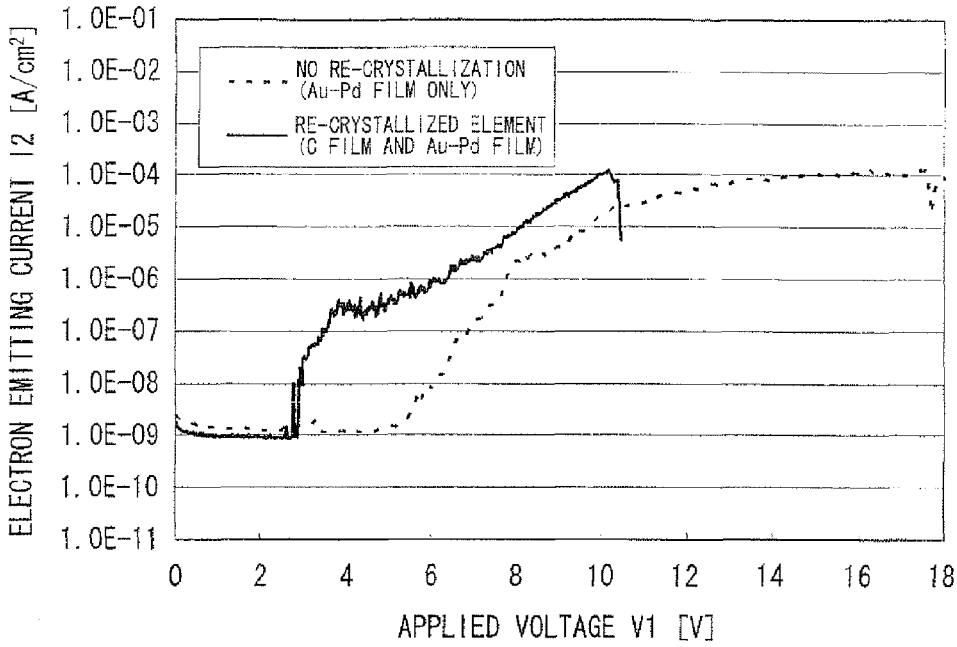
FIG. 9 is a graph showing a result of measurement of the electron emission current of the electron emitting element including the electron acceleration layer produced by use of the fine particle dispersion solution to which 0.0082 g of the crystalline electron transport agent is added, which measurement was carried out before/after the crystalline electron transport agent was re-crystallized in the electron acceleration layer.

FIG. 9 shows a result of the measurement of the electron emission current I2 [unit: A/cm$^2$] of the electron emitting element 1 to which 0.082 g of the crystalline electron transport agent 9 was added (the same as the electron emitting element in FIG. 8). The measurement was carried out before/after the crystalline electron transport agent 9 was re-crystallized in the electron emitting element 1. The electron emitting element 1 in which the crystalline electron transport agent 9 had been re-crystallized started emitting electrons with an applied voltage of 3 V, and exhibited an amount of emitted electrons, which was higher by approximately single or double digits than that of the electron emitting element 1 in which the crystalline electron transport agent 9 had not been re-crystallized. Further, as shown in FIGS. 8 and 9, in the electron emitting element 1 in which the crystalline electron transport agent had been re-crystallized, the current I1 in the element reached an upper limit of a supply capacity of the power supply with an applied voltage V1 of approximately 10 V, so that the short-circuit occurred, and the electron emission current I2 started decreasing. Such a situation is also likely to occur in a case where the DC voltage is continuously applied, even if the applied DC voltage is low. Therefore, it is necessary to modify the waveform of the applied voltage.

Figure 10:
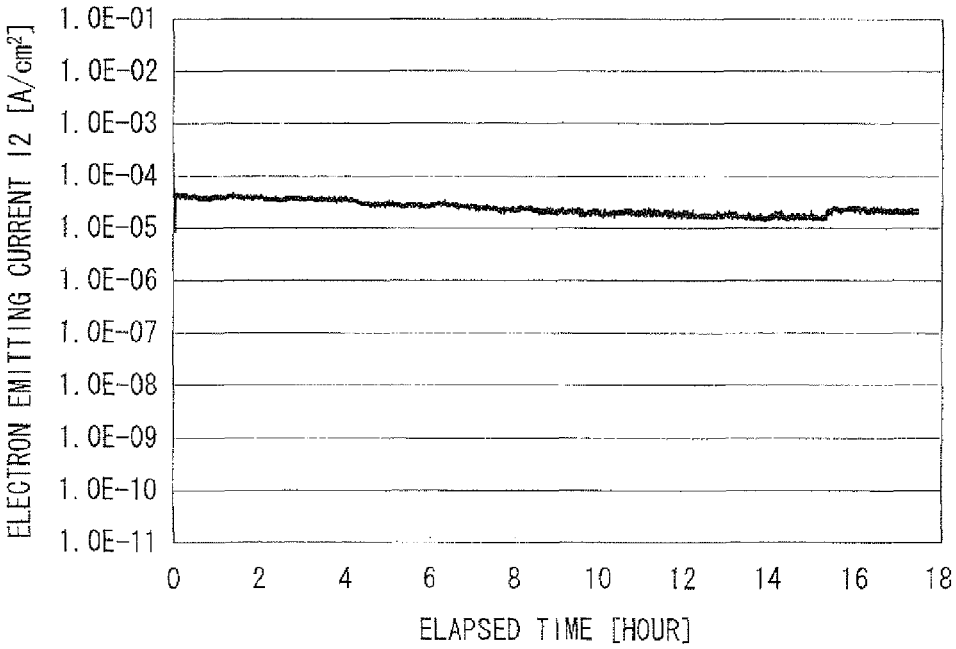
FIG. 10 is a graph showing how the electron emission current of the electron emitting element changes as the electron emitting element is driven with a pulsed voltage in vacuum, which electron emitting element includes the electron acceleration layer in which the crystalline electron transport agent has been re-crystallized.

FIG. 10 shows how the electron emission current I2 of the electron emitting element 1 changed in the vacuum condition as the electron emitting element 1 was driven, which electron emitting element 1 (i) was produced by use of the fine particle dispersion solution to which 0.082 g of the crystalline electron transport agent 9 was added, (ii) contained the crystalline electron transport agent 9 that had been re-crystallized. The applied voltage was not the DC voltage but a positive pulsed voltage. Note that the pulsed voltage had (i) a pulse frequency was 10 kHz, (ii) a pulse height was 14 $V_{0\text{-}p}$, and (iii) a ratio (duty) of a time period during which the applied voltage was an On state was 10%. While the electron emitting element 1 was continuously driven for approximately 18 hours, the electron emission current I2 in the element was highly stable although the electron emission current I2 slightly decreased.

Figure 11:
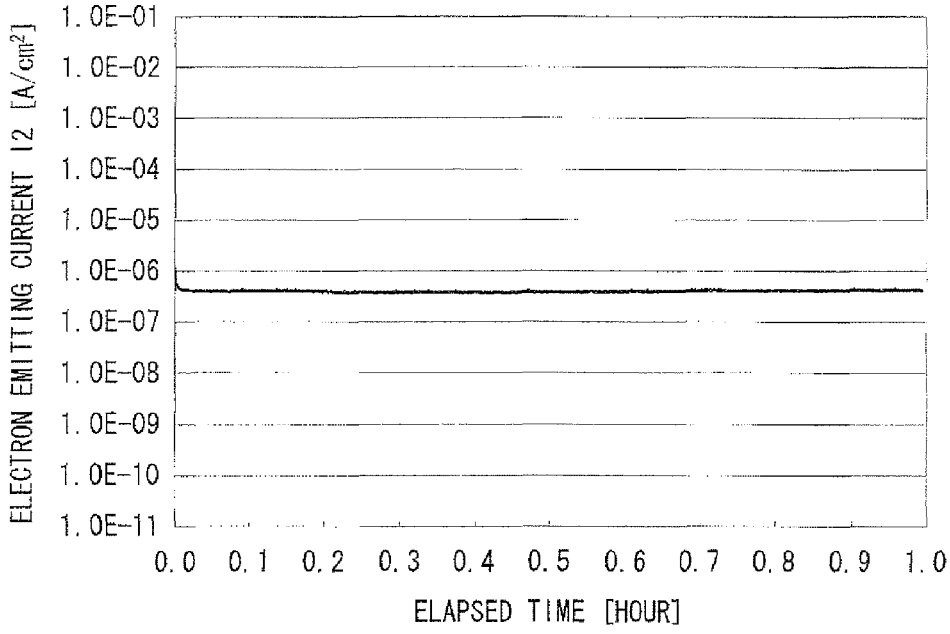
FIG. 11 is a graph showing how the electron emission current of the electron emitting element changes as the electron emitting element is driven with the pulsed voltage in the atmosphere, which electron emitting element includes the electron acceleration layer in which the crystalline electron transport agent has been re-crystallized.

FIG. 11 shows how the electron emission current of the electron emitting element 1 changed in the atmosphere under the same condition as that of FIG. 10, as the electron emitting element 1 was continuously driven, which electron emitting element 1 was the same as that of FIG. 10. In this experiment, the applied voltage V2 applied to the counter electrode 12 was 200 V. FIG. 11 shows that although the electron emission current I2 decreased by approximately double digits as compared with the above experiment carried out in vacuum, it was possible to realize a stable electron emission property.

Figure 12:
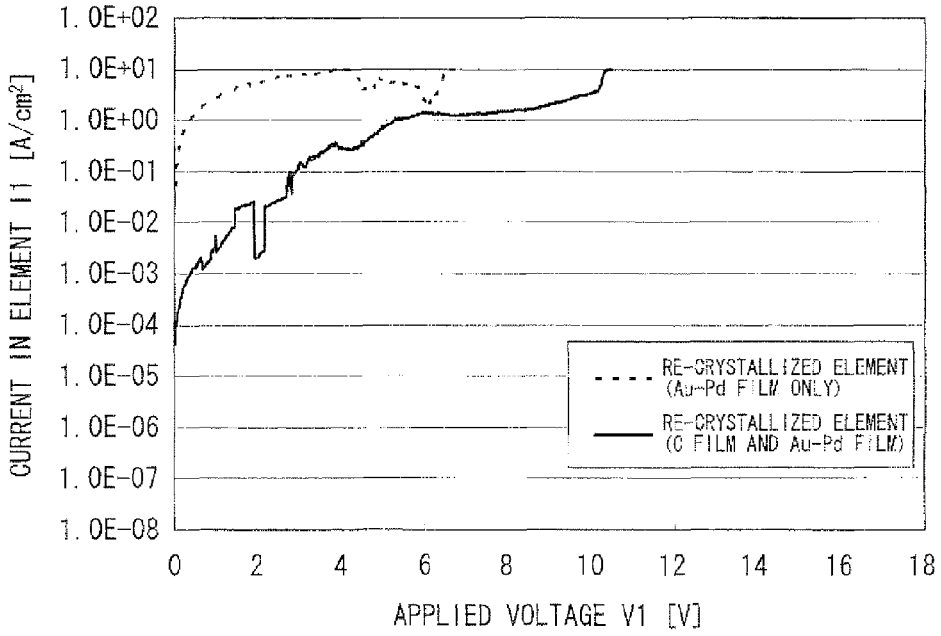
FIG. 12 is a graph showing a result of measurement of a current flowing in each of (i) an electron emitting element including a thin-film electrode made of only a metal film made from gold and palladium, and (ii) an electron emitting element including a thin-film electrode made of an amorphous carbon film and a metal film made from gold and palladium.
Figure 13:
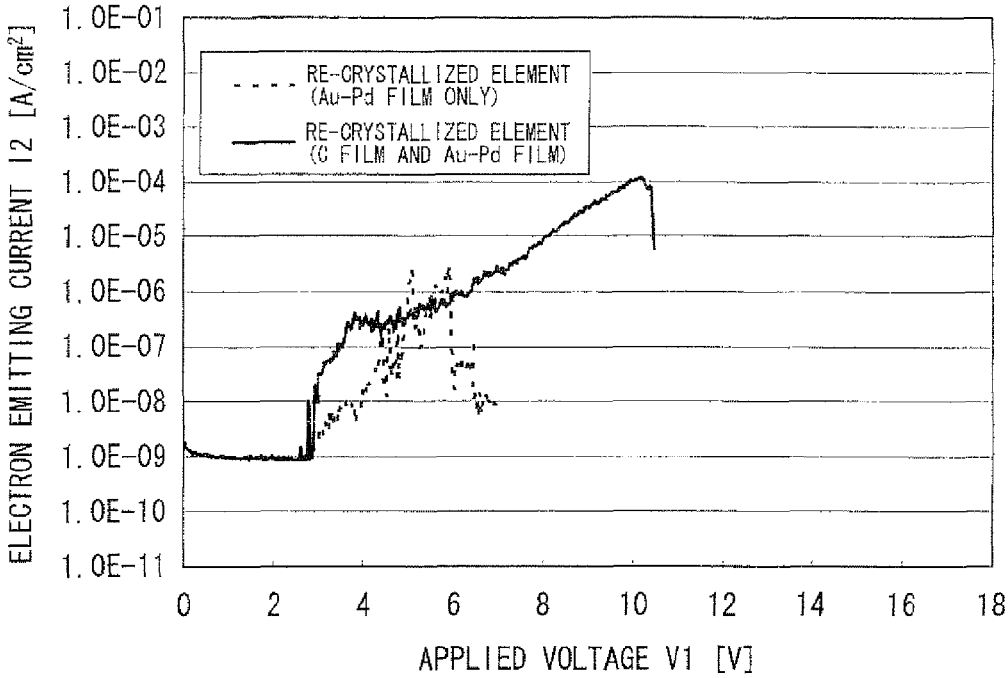
FIG. 13 is a graph showing a result of measurement of an electron emission current of each of (i) the electron emitting element including the thin-film electrode made of only the metal film made from gold and palladium, and (ii) the electron emitting element including the thin-film electrode made of the amorphous carbon film and the metal film made from gold and palladium.

Next, the following description deals with a comparison between the electron emitting element 1 in which both the resistance layer 5 made of the amorphous carbon film, and the metal layer 6 were provided, and the electron emitting element 1 in which only the metal layer 6 was provided. Each of the electron emitting elements 1 was produced by use of the fine particle dispersion solution to which 0.082 g of the crystalline electron transport agent 9 was added. The comparison was made in terms of the current in the element and the electron emission current. FIGS. 12 and 13 show the result of the comparison. FIG. 12 shows that the electron emitting element 1 without the resistance layer 5 had an increase in the current in the element with a low applied voltage. Further, FIG. 13 shows that both the electron emitting elements 1 started emitting electrons with an applied voltage V1 of 3 V (regardless of whether or not the electron emitting element 1 includes the resistance layer 5), but the electron emitting element 1 without the resistance layer 5 could not sufficiently emit electrons due to the upper limit of supply capacity of the device shortly after starting the electron emission. From these results, it was found that (i) the current flowing in the electron emitting element 1 can be limited by provision of the resistance layer 5, and therefore (ii) an unnatural increase in the current can be prevented.

Embodiment 2

Figure 14:
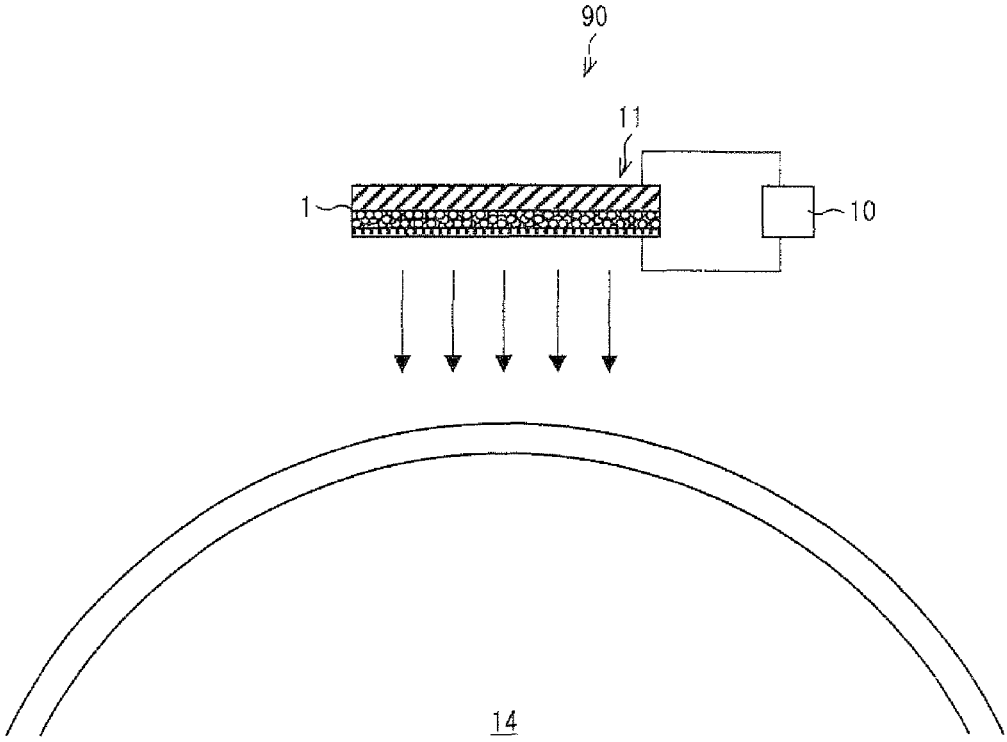
FIG. 14 is a view illustrating an example of a charging device employing the electron emitting device illustrated in FIG. 1.

FIG. 14 shows an example of a charging device 90 of the present invention, including an electron emitting device 11 employing an electron emitting element 1 in accordance with an embodiment of the present invention, which electron emitting element 1 is described in Embodiment 1.

The charging device 90 includes the electron emitting device 11 including the electron emitting element and a power supply 10 for applying a voltage to the electron emitting element 1. The charging device 90 is used for electrically charging a photoreceptor drum 14. An image forming apparatus of the present invention includes the charging device 90.

In the image forming apparatus of the present invention, the electron emitting element 1 in the charging device 90 is provided so as to face the photoreceptor drum 14 to be charged. Application of a voltage causes the electron emitting element 1 to emit electrons so that the photoreceptor drum 14 is electrically charged. In the image forming apparatus of the present invention, other than the charging device 90, known members can be used. The electron emitting element 1 in the charging device 90 is preferably provided so as to be, for example, 3 mm to 5 mm apart from the photoreceptor drum 14. Further, the voltage to be applied to the electron emitting element 1 is preferably a positive pulsed voltage. It is preferable that the pulsed voltage has (i) a pulse frequency is 10 kHz, (ii) a pulse height is 14 $V_{0\text{-}p}$, and (iii) a ratio (duty) of a time period in which the applied voltage is in an ON state is 10%. An electron acceleration layer 4 of the electron emitting element 1 should be configured such that 1 $\mu A/cm^2$ to 0.3 $\mu A/cm^2$ of electrons are emitted per unit of time in response to the application of the voltage described above, for example.

Further, the electron emitting device 11 serving as the charging device 90 is configured as a planar electron source. Therefore, the electron emitting device 11 is capable of charging the photoreceptor drum 14 on an area that has a width in a rotation direction. This provides many chances for charging a section of the photoreceptor 14. Therefore, the charging device 90 can perform a more uniform electric charging as compared to a wire charging device electrically charging line by line a section on the photoreceptor drum 14. Further, the charging device 90 has such an advantage that the applied voltage is approximately 10 V which is far lower than that of a corona discharge device which requires an applied voltage of a few kV.

Embodiment 3

Figure 15:
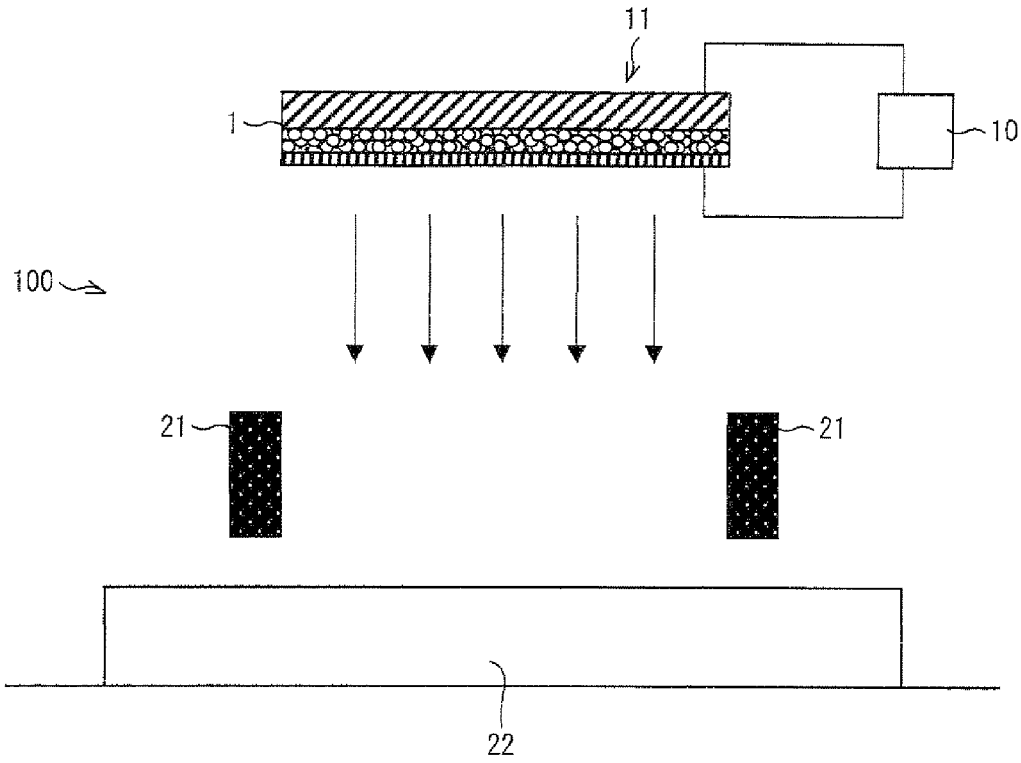
FIG. 15 is a view illustrating an example of an electron-beam curing device employing the electron emitting device illustrated in FIG. 1.

FIG. 15 shows an example of an electron-beam curing device 100 of the present invention including an electron emitting device 11 employing an electron emitting element 1 in accordance with an embodiment of the present invention, which electron emitting element 1 is described in Embodiment 1.

The electron-beam curing device 100 includes: the electron emitting device 11 including the electron emitting element 1 and a power supply 10 for applying a voltage to the electron emitting element 1; and an accelerating electrode 21 for accelerating electrons. In the electron-beam curing device 100, the electron emitting element 1 serving as an electron source emits electrons, and the emitted electrons are accelerated by the accelerating electrode 21 so that the electrons collide with a resist (an object to be cured) 22. Energy necessary for curing the general resist 22 is not more than 10 eV. In terms of energy, the accelerating electrode 21 is not necessary. However, a penetration depth of an electron beam is determined by a function of energy of electrons. For example, in order to entirely cure the resist 22 having a thickness of 1 μm, an accelerating voltage of approximately 5 kV is required.

In a conventional general electron-beam curing device, an electron source is sealed in vacuum and caused to emit electrons by application of a high voltage (in a range of 50 kV to 100 kV). The electrons are taken out through an electron window and used for irradiation. According to the above electron emission method, when the electrons pass through the electron window, loss of a large amount of energy occurs in the electrons. Further, the electrons that reach the resist pass through the resist in the thickness direction because the electrons have high energy. This decreases energy utilization efficiency. In addition, because an area on which electrons are thrown at a time is small and irradiation is performed in a manner drawing with dots, throughput is low.

On the other hand, the electron-beam curing device 100 employing the electron emitting device 11 is free from energy loss because the electrons do not pass through the electron window. This allows reducing an applied voltage. Moreover, since the electron-beam curing device 100 has a planar electron source, the throughput increases significantly. In a case where electrons are emitted in accordance with a pattern, it is possible to perform a maskless exposure.

Embodiment 4

Figure 16:
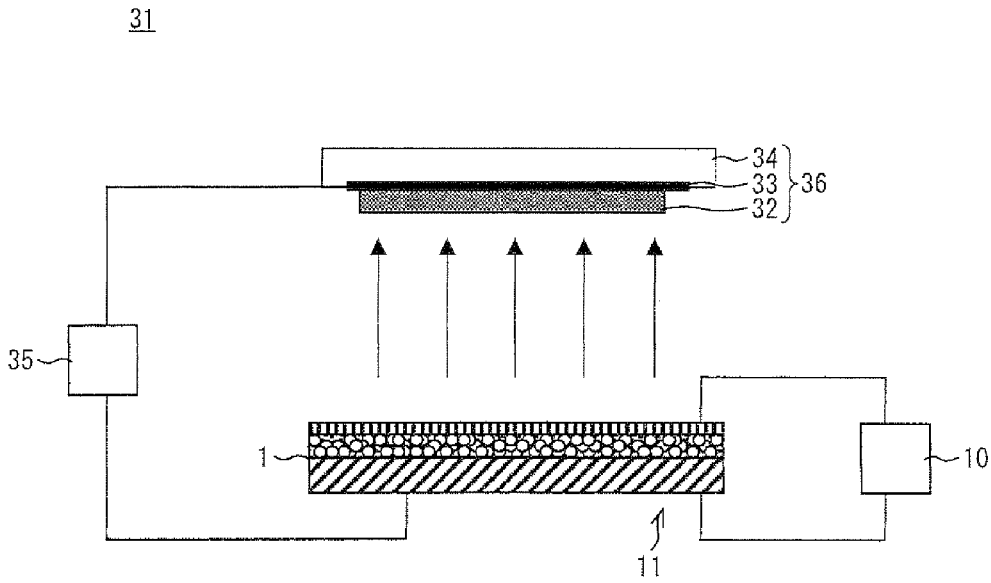
FIG. 16 is a view illustrating an example of a light emitting device employing the electron emitting device illustrated in FIG. 1.
Figure 17:
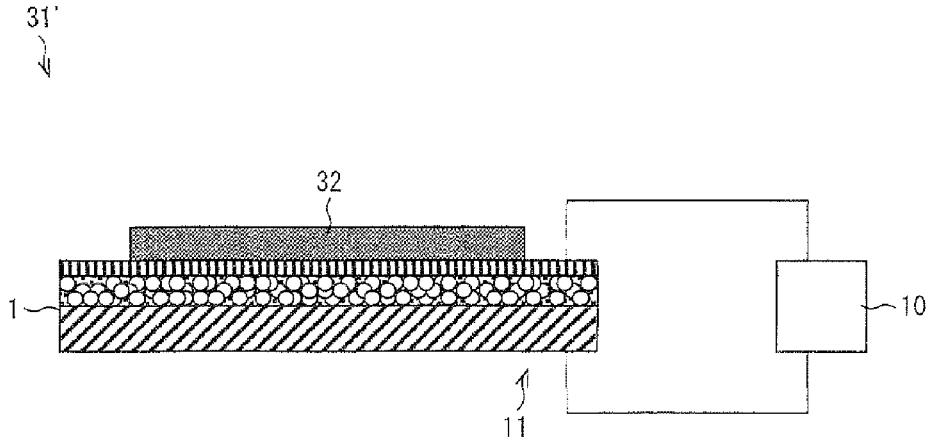
FIG. 17 is a view illustrating another example of the light emitting device employing the electron emitting device illustrated in FIG. 1.
Figure 18:
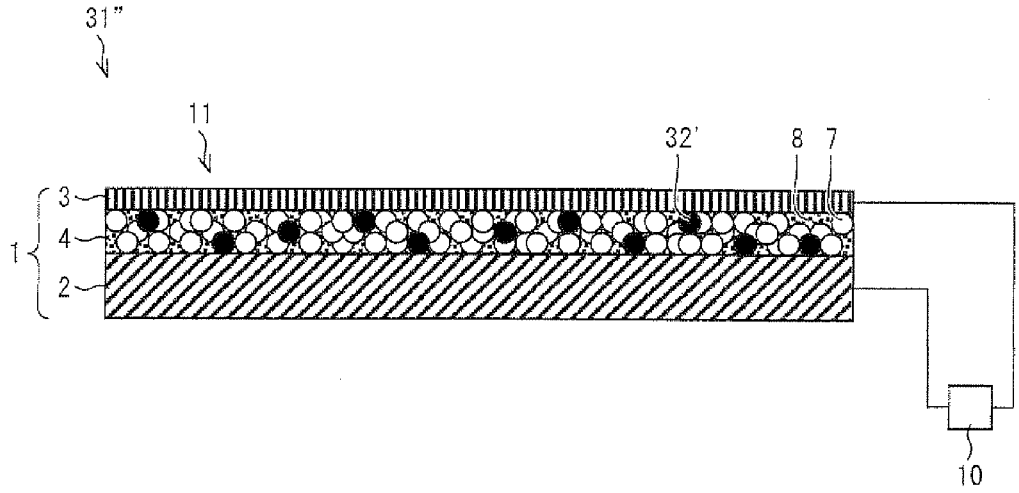
FIG. 18 is a view illustrating further another example of the light emitting device employing the electron emitting device illustrated in FIG. 1.

FIGS. 16 through 18 show examples of respective light emitting devices of the present invention each including an electron emitting device 11 including an electron emitting element 1 in accordance with an embodiment of the present invention, which electron emitting element 1 is described in Embodiment 1.

The light emitting device 31 illustrated in FIG. 16 includes: the electron emitting device 11 including an electron emitting element 1 and a power supply 10 for applying a voltage to the electron emitting element 1; and a light-emitting section 36 having a laminated structure including a glass substrate 34 as a base material, an ITO film 33, and a luminous body 32. The light emitting section 36 is provided in a position that is apart from the electron emitting element 1 so as to face the electron emitting element 1.

Suitable materials of the luminous body 32 are materials that are excited by electrons and that correspond to red light emission, green light emission, and blue light emission, respectively. Examples usable as such materials corresponding to red are $Y_2O_3$:Eu, and (Y, Gd) $Bo_3$:Eu; examples usable as such materials corresponding to green are $Zn_2SiO_4$:Mn and $BaAl_{12}O_{19}$:Mn; and an example usable as such materials corresponding to blue is $BaMgAl_{10}O_{17}:Eu^{2+}$. The luminous body 32 is formed on the ITO film 33 which is formed on the glass substrate 34. It is preferable that the luminous body 32 is approximately 1 μm in thickness. Further, the ITO film 33 may have any thickness as long as the ITO film 33 can reliably have electric conductivity at the thickness. In the present embodiment, the ITO film 33 is set to be 150 nm in thickness.

For forming a film of the luminous body 32, a mixture of epoxy resin serving as a binder and luminous-body fine particles is prepared, and a film of the mixture may be formed by a known method such as a bar coater method or a dropping method.

In this embodiment, in order to increase a brightness of light emitted from the luminous body 32, it is necessary to accelerate, toward the luminous body 32, electrons which are emitted from the electron emitting element 1. In order to realize such acceleration, it is preferable that a power supply 35 should be provided between the electrode substrate 2 of the electron emitting element 1 and the ITO film 33 of the light-emitting section 36. This allows application of a voltage in order to form an electric field for accelerating the electrons. In this case, it is preferable that (i) a distance between the luminous body 32 and the electron emitting element 1 is in a range of 0.3 mm to 1 mm (ii) a voltage applied by the power supply 10 is a positive pulsed voltage. It is preferable that the pulsed voltage has (i) a pulse frequency is 10 kHZ, (ii) a pulse height is $14V_{0\text{-}p}$, and (iii) a ratio (duty) of a time period during which the applied voltage is in an ON state is 10%. Further, it is preferable that a voltage applied by the power supply 35 is in a range of 500 V to 2000 V.

A light emitting device 31' shown in FIG. 17 includes the electron emitting device 11 including an electron emitting element 1 and a power supply 10 for applying a voltage to the electron emitting element 1, and a luminous body (light emitting body) 32. In the light emitting device 31', the luminous body 32 is a planar luminous body which is provided on a surface of the electron emitting element 1. In the present embodiment, a layer of the luminous body 32 is formed on a surface of the electron emitting element 1, in such a manner that a mixture of epoxy resin serving as a binder and luminous-body particles is prepared as described above and a film of the mixture is formed on the surface of the electron emitting element 1. Note that, because the electron emitting element 1 itself has a structure which is vulnerable to external force, the element may be damaged as a result of use of the bar coater method. Therefore, it is preferable to use the dropping method or the spin coating method.

The light emitting device 31" shown in FIG. 18 includes the electron emitting device 11 including an electron emitting element 1 and a power supply 10 for applying a voltage to the electron emitting element 1. Further, fluorescent fine particles are mixed, as a luminous body (light emitting body) 32', in a fine particle layer 4 of the electron emitting element 1. In this case, the luminous body 32' may be configured to also serve as the insulating fine particles 7. Generally, however, the luminous-body fine particles have a low electric resistance. As compared to electric resistance of the insulating fine particles 7, the electric resistance of the luminous-body fine particles is clearly lower. Therefore, when the luminous-body fine particles are mixed in replacement of the insulating fine particles 7, an amount of the luminous-body fine particles should be suppressed to a small amount. For example, when spherical silica particles (average particle diameter of 110 nm) are used as the insulating fine particles 7 and ZnS:Mg (average particle diameter of 500 nm) are used as the luminous-body fine particles, an appropriate mixture ratio by weight of the insulating fine particles 7 to the luminous-body fine particles is approximately 3:1.

In the above light emitting devices 31, 31', and 31" electrons emitted from the electron emitting element 1 are caused to collide with the corresponding fluorescent bodies 32 and 32' so that light is emitted. Because the electron emitting element 1 is increased in amount of electron emission, each of the light emitting devices 31, 31', and 31" can efficiently emit light. Note that in a case where each of the light emitting devices 31, 31', and 31" is sealed in vacuum, an electron emitting current of each of the light emitting devices 31, 31', and 31" is increased. In this case, it becomes possible for each of the light emitting devices 31, 31', and 31" to emit light more efficiently.

Figure 19:
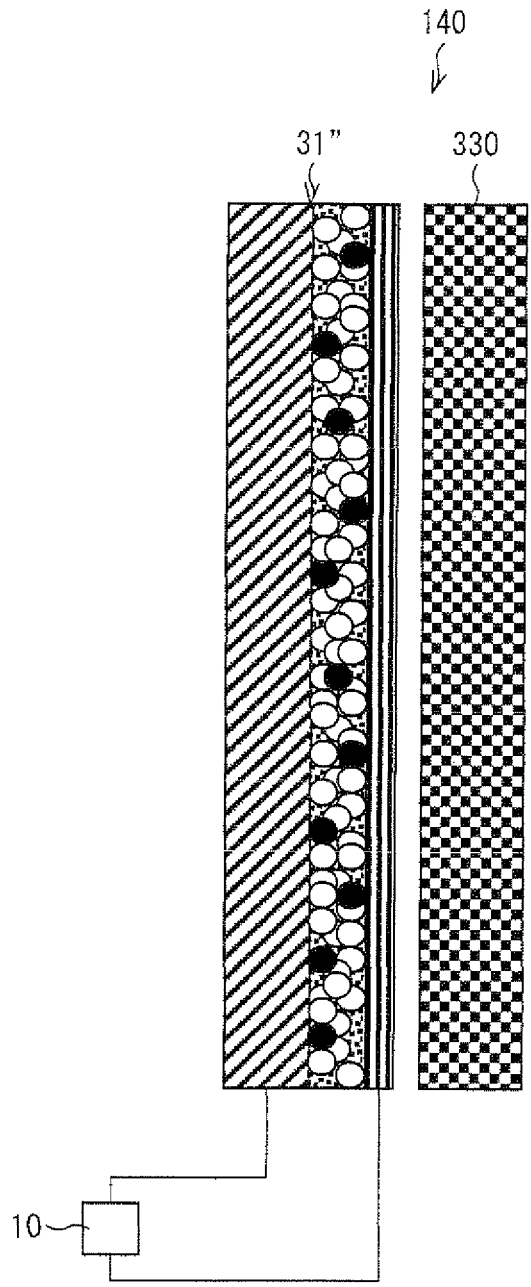
FIG. 19 is a view illustrating an example of an image display apparatus employing the light emitting device employing the electron emitting device illustrated in FIG. 1.

FIG. 19 illustrates an example of an image display device of the present invention which includes a light emitting device of the present invention. An image display device 140 illustrated in FIG. 19 includes a light emitting device 31" illustrated in FIG. 18, and a liquid crystal panel 330. In the image display device 140, the light emitting device 31" is provided behind the crystal panel 330 and used as a backlight. In a case where the light emitting device 31" is used in the image display device 140, it is preferable that a positive pulsed voltage is applied to the light emitting device 31". It is preferable that the pulsed voltage has (i) a pulse frequency is 10 kHz, (ii) a pulse height is $14V_{0\text{-}p}$, and (iii) a ratio (duty) of a time period during which the applied voltage is in an ON state is 10%. The light emitting device 31" should be configured to emit, for example, 1 $\mu A/cm^2$ to 0.3 $\mu A/cm^2$ of electrons per unit of time at the voltage described above. Further, it is preferable that a distance between the light emitting device 31" and the liquid crystal panel 330 is approximately 0.1 mm.

Embodiment 5

Figure 20:
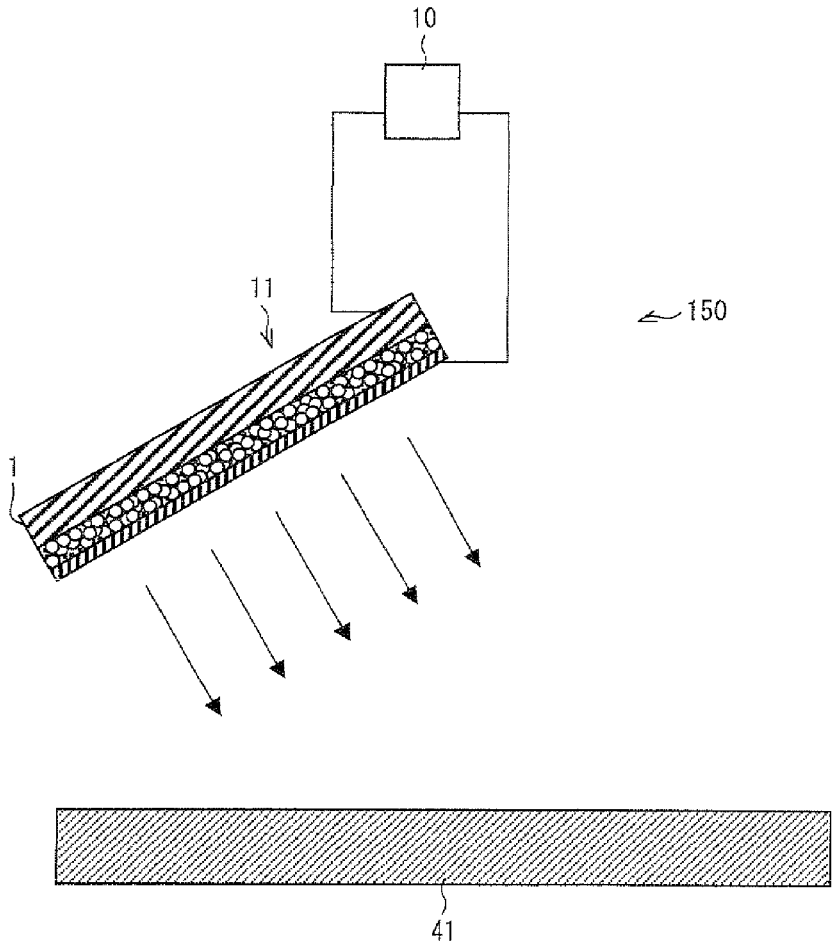
FIG. 20 is a view illustrating an example of an air blowing device employing the electron emitting device illustrated in FIG. 1, and an example of a cooling device employing the air blowing device.
Figure 21:
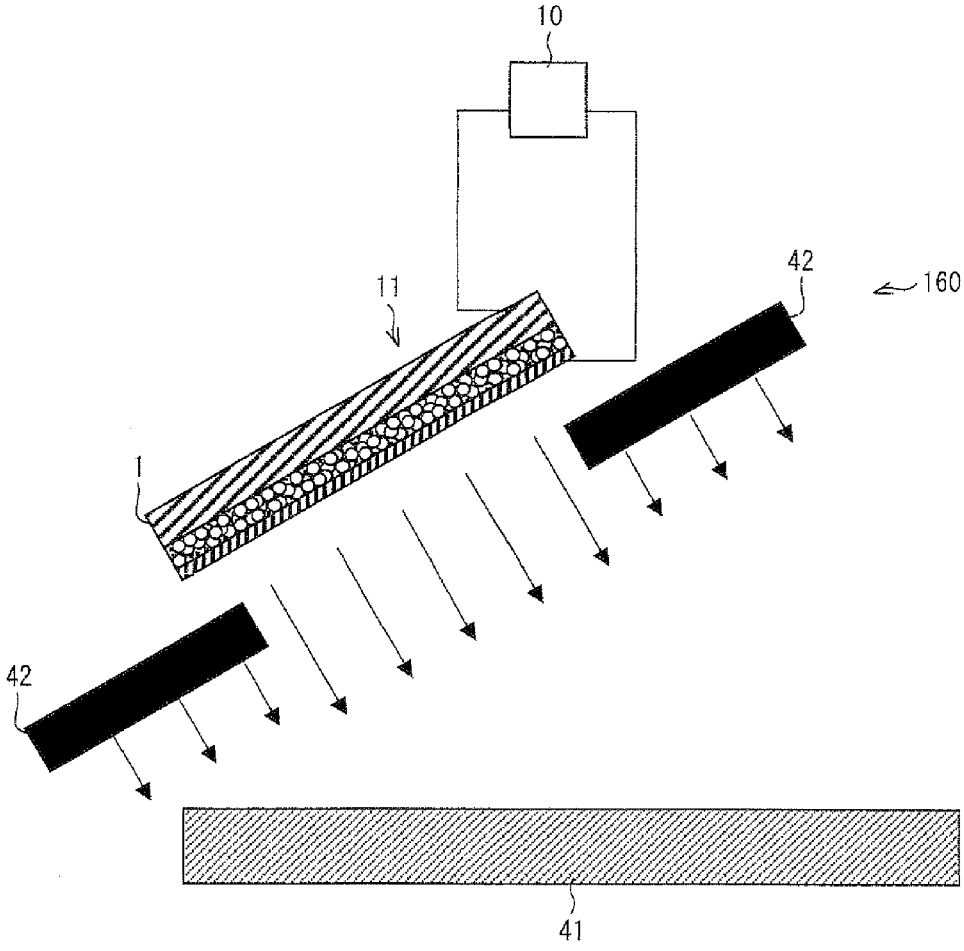
FIG. 21 is a view illustrating another example of the air blowing device employing the electron emitting device illustrated in FIG. 1 and another example of the cooling device employing the air blowing device.

FIGS. 20 and 21 show examples of air blowing devices 150 and 160 of the present invention each including an electron emitting device 11 employing an electron emitting element 1 in accordance with an embodiment of the present invention, which electron emitting element 1 is described in Embodiment 1. The following explanation deals with a case where each of the air blowing devices of the present invention is used as a cooling device. However, application of the air blowing device is not limited to a cooling device.

The air blowing device 150 illustrated in FIG. 20 includes the electron emitting device 11 including the electron emitting element 1 and a power supply 10 for applying a voltage to the electron emitting element 1. In the air blowing device 150, the electron emitting element 1 emits electrons toward an object 41 to be cooled so that ion wind is generated and the object 41 electrically grounded is cooled. In a case where the object 41 is cooled, it is preferable that a positive pulsed voltage is applied to the electron emitting element 1. It is preferable that the pulsed voltage has (i) a pulse frequency is 10 kHz, (ii) a pulse height is $14\ V_{0\text{-}p}$, and (iii) a ratio (duty) of a time period during which the applied voltage is in an ON state is 10%. Further, it is preferable that at this applied voltage, the electron emitting element 1 emits, for example, 1 $\mu A/cm^2$ to 0.3 $\mu A/cm^2$ of electrons per unit of time in the atmosphere.

In addition to the arrangement of the air blowing device 150 illustrated in FIG. 20, an air blowing device 160 illustrated in FIG. 21 further includes a blowing fan 42. In the air blowing device 160 illustrated in FIG. 21, an electron emitting element 1 emits electrons toward an object 41 to be cooled and the blowing fan 42 blows the electrons toward the object 41 so that the object 41 electrically grounded is cooled down by generation of ion wind. In this case, it is preferable that an air volume generated by the blowing fan 42 is in a range of 0.9 L to 2 L per minute per square centimeter.

Now, a ease where the object 41 is to be cooled by blowing air is considered. In a case where the object 41 is cooled by blowing only the atmospheric air with use of a fan or the like as in a conventional air blowing device or a conventional cooling device, cooling efficiency is low because a flow rate on a surface of the object 41 becomes 0 and the air in a section from which heat should be dissipated the most is not replaced. However, in cases where electrically charged particles such as electrons or ions are included in the air sent to the object 41 as a wind (airflow), the air sent to the object 41 is attracted to the surface of the object 41 by electric force in the vicinity of the object 41. This makes it possible to replace the air in the vicinity of the surface of the object 41. In the present embodiment, because the air blowing devices 150 and 160 of the present invention blow air including electrically charged particles such as electrons or ions, the cooling efficiency is significantly improved.

[Arrangement of the Present Invention]

An electron emitting element of the present invention includes: an electrode substrate; a thin-film electrode facing the electrode substrate; and an electron acceleration layer sandwiched between the electrode substrate and the thin-film electrode, as a result of a voltage applied between the electrode substrate and the thin-film electrode, electrons being accelerated in the electron acceleration layer so as to be emitted from the thin-film electrode, the electron acceleration layer including (1) conductive fine particles which are made of a conductor and have a high resistance to oxidation, (2) insulating fine particles having an average particle diameter greater than an average particle diameter of the conductive fine particles, and (3) a crystalline electron transport agent, the crystalline electron transport agent being crystallized to crystals.

According to the arrangement in which the crystalline electron transport agent is crystallized in the electron acceleration layer, it is possible to cause the electron emitting element to emit electrons in an amount equal to or more than an amount of electrons emitted from a conventional element, with an applied voltage lower than an applied voltage of the conventional element. Such a reduction in the applied voltage can lead to advantages of life extension of the electron emitting element, a reduction in power consumption, etc. Further, it becomes possible to provide an electron emitting element which can efficiently emit electrons, at low cost, without using an expensive material for the electron acceleration layer.

In the electron emitting element of the present invention, the crystalline electron transport agent may be crystallized so as to penetrate the electron acceleration layer in a layer thickness direction of the electron acceleration layer.

According to the arrangement, the crystalline electron transport agent is crystallized so as to penetrate the electron acceleration layer in the layer thickness direction of the electron acceleration layer. Therefore, a current path is formed between the crystallized crystalline electron transport agent penetrating from the electron acceleration layer and fine particles. Therefore, it is expected that a greater amount of electrons can be emitted.

Here, the crystalline electron transport agent may be crystallized so as to have a needle shape. In a case where the crystalline electron transport agent is crystallized to have a needle shape, the crystalline electron transport agent can easily grow in the layer thickness direction of the electron acceleration layer and therefore easily penetrate the electron acceleration layer. Because of this, a current path can be easily formed.

Further, the crystalline electron transport agent may be soluble in a dispersion solution in which the insulating fine particles and the conductive fine particles are dispersed, and the crystalline electron transport agent may be crystallized by re-crystallization after the electron acceleration layer is formed by use of the dispersion solution including the crystalline electron transport agent. According to the arrangement, it is possible to easily form the electron emitting element.

In the electron emitting element of the present invention, in addition to the arrangement, the conductor that the conductive fine particles are made of may contain at least one of gold, silver, platinum, palladium, and nickel. Because the conductor that the conductive fine particles are made of contains at least one of gold, silver, platinum, palladium, and nickel, it becomes possible to more effectively prevent element degradation such as oxidation of the conductive fine particles caused by oxygen in the atmosphere. This makes it possible to efficiently extend a life of the electron emitting element.

Further, in the electron emitting element of the present invention, the insulating fine particles preferably have an average particle diameter in a range of 10 nm to 1000 nm, more preferably in a range of 10 nm to 200 nm. In such a case, diameters of the fine particles may be broadly distributed with respect to the average particle diameter. For example, insulating fine particles having an average particle diameter of 50 nm may have particle diameter distribution in a range of 20 nm to 100 nm. In a case where a particle size of the insulating fine particles is too small, the fine particles are likely to gather together due to a strong forth generated between the fine particles. This makes it difficult to disperse the fine particles. Further, in a case where the particle size of the insulating fine particles is too large, it becomes difficult to adjust a resistance by adjusting a layer thickness of the electron acceleration layer or a compounding ratio of a surface conduction material.

Here, in the electron emitting element of the present invention, the crystalline electron transport agent may be made of, but not limited to, diphenoquinone.

In the electron emitting element of the present invention, in addition to the arrangement, a layer thickness of the electron acceleration layer is preferably in a range of 12 nm to 6000 nm, more preferably in a range of 300 nm to 1000 nm. By adjusting the layer thickness of the electron emitting layer to be in the above range, it becomes possible to cause the electron acceleration layer to have an even layer thickness. It also becomes possible to control a resistance of the electron acceleration layer in a layer thickness direction. As a result, electrons can be emitted from all over a surface of the electron emitting element uniformly. Further, the electrons can be emitted efficiently to the outside of the element.

In the electron emitting element of the present invention, in addition to the arrangement, the insulating fine particles may contain an organic polymer or at least one of $SiO_2$, $Al_2O_3$, and $TiO_2$. By arranging the insulating fine particles to contain an organic polymer or at least one of $SiO_2$, $Al_2O_3$, and $TiO_2$, it becomes possible to adjust a resistance value in any range due to a high insulating property of the above substances. In particular, in a case where oxide (of $SiO_2$, $Al_2O_3$, and $TiO_2$) is used as the insulating fine particles and a conductor having a high resistance to oxidation is used as the conductive fine particles, element degradation due to oxidation caused by oxygen in the atmosphere is made more difficult to occur.

Therefore, the effect of steadily operating the electron emitting element under the atmospheric pressure can be obtained more significantly.

Here, according to the arrangement, the electron emitting element can emit electrons with a lower applied voltage, while having a significant reduction in a resistance in the element. Therefore, it becomes difficult to maintain a withstand pressure of the electron emitting element with respect to the repeated application of the voltage. In view of this, in order to suppress an unusual increase in a current flowing through the electron emitting element by limiting the current, it is preferable to provide a resistance layer on the electron acceleration layer. The addition of the resistance layer can realize an electron emitting element which can stably emit electrons with a low applied voltage.

In the electron emitting element of the present invention, in addition to the arrangement, (i) the thin-film electrode may include a resistance layer and a metal layer laminated such that the resistance layer is in contact with the electron acceleration layer, (ii) the resistance layer may be made of an amorphous carbon film or a nitride film, and (iii) the metal layer may contain at least one of gold, silver, tungsten, titanium, aluminum, and palladium.

According to the arrangement in which the thin-film electrode includes the resistance layer, it becomes possible to suppress an unusual increase in the current flowing through the element by limiting the current. Note that the resistance layer is provided between the electron acceleration layer and the metal layer serving as a surface of the electron emitting element.

The amorphous carbon film, used as the resistance layer, is such that clusters (aggregates each being constituted by hundreds of atoms) each having a graphite structure having so-called SP2 hybrid orbitals, are accumulated disorderly. The graphite itself is excellent in electrical conductivity. However, the electrical conduction between the clusters is poor due to the accumulation state of the clusters. Accordingly, the amorphous carbon film functions as the resistance layer accordingly. Further, the nitride film also can be used as the resistance layer.

Further, in the electron emitting element of the present invention, the metal layer serving as the surface of the electron emitting element may contain at least one of gold, silver, carbon, tungsten, titanium, aluminum, and palladium. Because the metal layer contains at least one of gold, silver, carbon, tungsten, titanium, aluminum, and palladium, tunneling of electrons generated by the electron acceleration layer becomes more efficient because of a low work function of the above substances. As a result, it becomes possible to emit more electrons having high energy to the outside of the electron emitting element.

An electron emitting device of the present invention includes: any one of the electron emitting elements described above; and a power supply section for applying a voltage between the electrode substrate and the thin-film electrode.

Here, the voltage supplied from the power supply section may be a DC voltage. However, it is preferable that the voltage supplied from the power supply section is a pulsed voltage. In response to the application of the pulsed voltage, the electron emitting device can have a more stable electron emission property while being continuously driven. The following description explains how the pulsed voltage causes the electron emitting element to have a more stable electron emission property.

In the electron emitting element of the present invention, having the arrangement described above, a current highly easily flows through the electron emitting element due to the crystalline electron transport agent which has been crystallized. Even if the thin-film electrode is made such that the amorphous carbon film or the nitride film, and the metal film are laminated with each other, in other words, even if the amorphous carbon film or the nitride film, serving as the resistance layer, is provided between the electron acceleration layer and the metal film, it is impossible to prevent an increase in the current in the element due to continuous driving of the electron emitting element. It is considered that when the DC voltage is applied, the increase in the current in the element is caused by gradual destruction of a part functioning as a resistance component in the current path. This ultimately leads to a short-circuit of the element and therefore the electron emission is interrupted. In order to suppress such an increase in the current in the element, the pulsed voltage is applied. This can suppress the destruction of the part functioning as the resistance component in the current path.

As described above, by modifying the structure of the electron emitting element and changing the waveform of the voltage to be applied, it becomes possible to provide the electron emitting device which can stably emit electrons with a low voltage.

Further, the scope of the present invention includes: a light emitting device; an image forming apparatus; an air blowing device; a cooling device; a charging device; an image forming apparatus; and an electron-beam curing device, each of which employs the electron emitting device of the present invention.

A method of the present invention, for producing an electron emitting element that includes: an electrode substrate; a thin-film electrode facing the electrode substrate; and an electron acceleration layer sandwiched between the electrode substrate and the thin-film electrode, as a result of a voltage applied between the electrode substrate and the thin-film electrode, electrons being accelerated in the electron acceleration layer so as to be emitted from the thin-film electrode, includes the steps of: forming the electrode acceleration layer by applying, on the electrode substrate, a dispersion solution in which insulating fine particles, conductive fine particles and a crystalline electron transport agent are dispersed; forming the thin-film electrode on the electron acceleration layer; and crystallizing the crystalline electron transport agent.

According to the method, it is possible to provide, at low cost, an electron emitting element which can sufficiently emit electrons with a low voltage, and has a long life time.

Further in the method, the crystalline electron transport agent may be crystallized so as to have a needle shape inside/outside the electron acceleration layer in the step of crystallizing.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

An electron emitting element of the present invention can emit ballistic electrons from a thin-film electrode by (i) ensuring electrical conduction and (ii) causing a sufficient current to flow in the electron emitting element. Therefore, the electron emitting element of the present invention can be suitably applicable to (i) a charging device of image forming apparatuses such as an electrophotographic copying machine, a printer, and a facsimile; (ii) an electron-beam curing device;

(iii) in combination with a luminous body, to an image display device; or (iv) by utilizing ion wind generated by electrons emitted from the electron emitting element, to a cooling device.

REFERENCE SIGNS LIST

1 Electron emitting element
2 Electrode substrate
3 Thin-Film Electrode
4 Electron acceleration layer
5 Resistance layer
6 Metal layer
7 Insulating fine particles
8 Conductive fine particles
9 Crystalline electron transport agent
10 Power supply (power supply section)
10A Power supply (power supply section)
10B Power supply
11 Electron emitting device
12 Counter electrode
13 Insulating spacer
14 Photoreceptor drum
21 Acceleration Electrode
22 Resist (Object to be cured)
31, 31', 31' Light emitting device
32, 32' Luminous body (Light emitting body)
33 ITO film
34 Glass substrate
35 Power Supply
36 Light emitting section
41 Object to be cooled
42 Air blowing fan
90 Charging device
100 Electron-beam curing device
140 Image display device
150 Air blowing device
160 Air blowing device
330 Liquid crystal panel

The invention claimed is:

1. An electron emitting element comprising:
an electrode substrate;
a thin-film electrode facing the electrode substrate; and
an electron acceleration layer sandwiched between the electrode substrate and the thin-film electrode,
as a result of a voltage applied between the electrode substrate and the thin-film electrode, electrons being accelerated in the electron acceleration layer so as to be emitted from the thin-film electrode,
the electron acceleration layer including (1) conductive fine particles which are made of a conductor and have a high resistance to oxidation, (2) insulating fine particles having an average particle diameter greater than an average particle diameter of the conductive fine particles, and (3) a crystalline electron transport agent,
the crystalline electron transport agent being crystallized to crystals.

2. The electron emitting element as set forth in claim 1, wherein:
the crystalline electron transport agent is crystallized so as to penetrate the electron acceleration layer in a layer thickness direction of the electron acceleration layer.

3. The electron emitting element as set forth in claim 1, wherein:
the crystalline electron transport agent is crystallized so as to have a needle shape.

4. The electron emitting element as set forth in claim 1, wherein:
the crystalline electron transport agent is soluble in a dispersion solution in which the insulating fine particles and the conductive fine particles are dispersed; and
the crystalline electron transport agent is crystallized by re-crystallization after the electron acceleration layer is formed by use of the dispersion solution including the crystalline electron transport agent.

5. The electron emitting element as set forth in claim 1, wherein:
the conductor, from which the conductive fine particles are made, contains at least one of gold, silver, platinum, palladium, and nickel; and
the conductive fine particles have an average particle diameter in a range of 3 nm to 10 nm.

6. The electron emitting element as set forth in claim 1, wherein:
the insulating fine particles have an average particle diameter in a range of 10 nm to 200 nm.

7. The electron emitting element as set forth in claim 1, wherein:
the crystalline electron transport agent is made of diphenoquinone.

8. The electron emitting element as set forth in claim 1, wherein:
the electron acceleration layer has a layer thickness in a range of 300 nm to 1000 nm.

9. The electron emitting element as set forth in claim 1, wherein:
the insulating fine particles contain an organic polymer or at least one of $SiO_2$, $Al_2O_3$, and $TiO_2$.

10. The electron emitting element as set forth in claim 1, wherein:
the thin-film electrode includes a resistance layer and a metal layer laminated such that the resistance layer is in contact with the electron acceleration layer.

11. The electron emitting element as set froth in claim 10, wherein:
the resistance layer is made of an amorphous carbon film or a nitride film; and
the metal layer contains at least one of gold, silver, tungsten, titanium, aluminum, and palladium.

12. An electron emitting device comprising:
an electron emitting element as set forth in claim 1; and
a power supply section for applying a voltage between the electrode substrate and the thin-film electrode.

13. The electron emitting device as set forth in claim 12, wherein:
the power supply section applies a pulsed voltage.

14. A light emitting device comprising:
an electron emitting device as set forth in claim 12, and
a luminous body,
the light emitting device causing the luminous body to emit light by causing the electron emitting device to emit electrons.

15. An image display device comprising:
a light emitting device as set forth in claim 14.

16. An air blowing device comprising:
an electron emitting device as set forth in claim 12,
the air blowing device causing the electron emitting device to emit electrons and blowing the electrons.

17. A cooling device comprising:
an electron emitting device as set forth in claim 12,
the cooling device cooling an object to be cooled by causing the electron emitting device to emit electrons.

18. A charging device comprising:

an electron emitting device as set froth in claim 12, the charging device charging a photoreceptor by causing the electron emitting device to emit electrons.

19. An image forming device comprising:

a charging device as set forth in claim 18.

20. An electron-beam curing device comprising:

an electron emitting device as set forth in claim 12, the electron-beam curing device curing an object to be cured by causing the electron emitting device to emit electrons.

21. A method for producing an electron emitting element that includes:

an electrode substrate;

a thin-film electrode facing the electrode substrate; and an electron acceleration layer sandwiched between the electrode substrate and the thin-film electrode, as a result of a voltage applied between the electrode substrate and the thin-film electrode, electrons being accelerated in the electron acceleration layer so as to be emitted from the thin-film electrode, the method comprising the steps of:

forming the electrode acceleration layer by applying, on the electrode substrate, a dispersion solution in which insulating fine particles, conductive fine particles and a crystalline electron transport agent are dispersed;

forming the thin-film electrode on the electron acceleration layer; and crystallizing the crystalline electron transport agent.

22. The method as set forth in claim 21, wherein:

the crystalline electron transport agent is crystallized so as to have a needle shape in said step of crystallizing.

23. The method as set forth in claim 21, wherein:

said step of forming the thin film electrode comprises (i) forming, on the electron acceleration layer, a resistance layer for limiting a current flowing in the electron emitting element, and (ii) forming a metal layer on the resistance layer.

* * * * *